US011759001B1

(12) United States Patent
Fulton et al.

(10) Patent No.: US 11,759,001 B1
(45) Date of Patent: Sep. 19, 2023

(54) BACKPACK FRAME SYSTEM

(71) Applicant: Frog Physics, LLC, Scottsdale, AZ (US)

(72) Inventors: Kimberly Fulton, Scottsdale, AZ (US); Stuart Melville, San Diego, CA (US)

(73) Assignee: Frog Physics, LLC, Scottsdale, AZ (US)

( * ) Notice: Subject to any disclaimer, the term of this patent is extended or adjusted under 35 U.S.C. 154(b) by 48 days.

(21) Appl. No.: 17/560,940

(22) Filed: Dec. 23, 2021

Related U.S. Application Data

(60) Provisional application No. 63/129,936, filed on Dec. 23, 2020.

(51) Int. Cl.
*A45F 3/08* (2006.01)

(52) U.S. Cl.
CPC ..... *A45F 3/08* (2013.01)

(58) Field of Classification Search
CPC ..... A45F 3/06; A45F 3/08; A45F 3/10
See application file for complete search history.

(56) References Cited

U.S. PATENT DOCUMENTS 4,602,654 A 7/1986 Stehling et al.
5,961,014 A 10/1999 Knerr
7,367,749 B2 * 5/2008 Kim ..... A62B 9/04 405/186
8,251,266 B2 8/2012 Gregory
8,469,245 B2 6/2013 Gregory
9,220,333 B2 * 12/2015 Losos ..... A45F 3/047
9,889,911 B1 2/2018 Stella et al.
11,313,644 B1 * 4/2022 Kirk ..... F41C 33/045
2006/0163305 A1 * 7/2006 Tong ..... A45F 3/08 224/628
2006/0283906 A1 * 12/2006 Laughton ..... A45F 3/04 224/583
2018/0177660 A1 * 6/2018 Davies ..... F16B 2/08

* cited by examiner

*Primary Examiner* — Derek J Battisti
(74) *Attorney, Agent, or Firm* — Shaddock Law Group, PC

(57) ABSTRACT

A backpack frame system having a frame element; and a coupling link including a frame link portion and an accessory link portion, wherein the accessory link portion includes at least one attachment portion, wherein the frame link portion is attached or coupled to the frame element, wherein the frame link portion includes a plurality of spaced apart frame link recess tabs separated by frame link spaces, wherein the accessory link portion includes a plurality of spaced apart accessory link protrusion tabs separated by accessory link spaces, wherein corresponding accessory link protrusion tabs may be inserted within a corresponding recess, and wherein the accessory link portion may be at least partially rotated relative to the frame link portion to engage corresponding accessory link protrusion tabs and frame link recess tabs.

20 Claims, 21 Drawing Sheets

100
150
150
150

BACKPACK FRAME SYSTEM

CROSS-REFERENCE TO RELATED APPLICATIONS

This patent application claims the benefit of U.S. Patent Application Ser. No. 63/129,936, filed Dec. 23, 2020, the disclosure of which is incorporated herein by reference in its entirety.

STATEMENT REGARDING FEDERALLY SPONSORED RESEARCH OR DEVELOPMENT

Not Applicable.

REFERENCE TO SEQUENCE LISTING, A TABLE, OR A COMPUTER PROGRAM LISTING COMPACT DISC APPENDIX

Not Applicable.

NOTICE OF COPYRIGHTED MATERIAL

The disclosure of this patent document contains material that is subject to copyright protection. The copyright owner has no objection to the reproduction by anyone of the patent document or the patent disclosure, as it appears in the Patent and Trademark Office patent file or records, but otherwise reserves all copyright rights whatsoever. Unless otherwise noted, all trademarks and service marks identified herein are owned by the applicant.

BACKGROUND OF THE PRESENT DISCLOSURE

1. Field of the Present Disclosure

The present disclosure relates generally to the field of backpack frame systems. More specifically, the presently disclosed systems, methods, and/or apparatuses relate to a backpack frame system adaptable to be used with a backpack or other backpack-style device.

2. Description of Related Art

It is generally known to have backpacks with either external or internal frame elements. It is more typical to have a backpack with an external frame element positioned inside of the bag or rucksack surrounded by a fabric portion or section.

As compared to traditional, external frame elements, internal frame elements are typically lighter and more compact than a backpack with an external frame element. Internal frame element backpacks offer greater adjustability and stability and are typically more comfortable for the wearer.

Any discussion of documents, acts, materials, devices, articles, or the like, which has been included in the present specification is not to be taken as an admission that any or all of these matters form part of the prior art base or were common general knowledge in the field relevant to the present disclosure as it existed before the priority date of each claim of this application.

BRIEF SUMMARY OF THE PRESENT DISCLOSURE

However, the typical backpack frame system arrangements have various shortcomings. For example, for example, known backpack frame systems can be rather expensive and are not typically as breathable or ventilated as alternative frame systems. Known backpack frame systems can make it difficult to attach external gear to the frame system.

In various exemplary, non-limiting embodiments, the backpack frame system of the present disclosure comprises a frame system, or "Fusion X-Frame element", and a "Frog Link" coupling device or link. The backpack frame system is designed to be utilized over a wide range of industries and applications as a versatile and modular attachment platform. It streamlines and eases the workload of the user, thereby creating a better experience with numerous functions. The versatility and engagement method of the coupling link design creates a near endless solution for carrying and mounting loads and is adapted to personal use in the frame system.

In various exemplary, non-limiting embodiments, the attachment or coupling has male and female components that link together in a manner that ensures a secure attachment or coupling between the components of the coupling link. The coupling link can be scaled up or down depending on the need. The coupling link can also be made out of various materials depending on the strength and weight requirements of the user.

The coupling link can be utilized over a wide array of applications. (i.e., mounting weapons/military hardware, gear, tools, electronics, bags/packs, tv/monitors, fire extinguishers, etc.).

For example, comparatively smaller versions may be used to attach gear to the frame system such as scuba tanks for divers and air bottles for fire fighters. Larger versions can be utilized to attach objects such as spare tires or modified gas cans and kit bags to vehicles.

In various exemplary embodiments, the coupling link eliminates redundancies in attachment issues by allowing an item to be quickly detached from one location and easily attached to another. This will increase a user's ability to quickly change items and be ensured of a solid attachment that cannot be duplicated with the use of straps.

In various exemplary, nonlimiting embodiments, the frame system is an ergonomic, streamlined, form fitting backpack exo-skeleton frame element designed to be modified to fit a variety of body types and sizes. The frame system may optionally be constructed of carbon Kevlar, which is very lightweight and stronger than steel. It has ballistic ratings making it resistant to certain calibers of ammunition and shrapnel. In various exemplary embodiments, a plurality of neodymium magnets may optionally be attached, coupled, or embedded within at least one layer of carbon Kevlar on the backside of the frame system, which are used to attach four different styles of padding to the frame element.

This adds to the modular functionality and is unique in its ability to transform to various user requirements (i.e.; transitioning from maritime/diving to land or from airborne/parachute to ground operations). Passive radio frequency identification (RFID) technology is embedded into the frame element for serialization and accountability purposes and there is also a designated area for affixing GPS/Bluetooth tracking devices, if so desired.

The ergonomically designed frame system may optionally be constructed in numerous options of carbon Kevlar colors and patterns, as well as other materials, providing various functional choices based on needs of the customer.

The shoulder straps/harness will have several different options (via multiple attachment points) that will enable the user to switch out equipment depending on environment. The female end of the coupling device is embedded into the frame element for strength and durability. The frame system itself is contoured to accommodate many styles, and the inclusion of multiple retention slots for straps allows the frame element to meet a full range of user preferences.

In order to overcome the shortcomings of the currently known backpack frame systems and/or to provide an improved backpack frame system, in various exemplary, non-limiting embodiments, the backpack frame system of the present disclosure comprises at least some of a frame element having a front surface and a rear surface, wherein the frame element extends from a top to an upper portion, from the upper portion to a central portion, from the central portion to a lower portion, and from the lower portion to a bottom, wherein the frame element extends to one or more sides, and wherein a coupling link opening is formed within a portion of the central portion; and a coupling link, wherein the coupling link includes a frame link portion and an accessory link portion, wherein the accessory link portion includes at least one attachment portion, which provides one or more areas, portions, or devices for attaching or coupling a load or other device the accessory link portion, wherein the accessory link portion includes a protrusion configured to fit at least partially within a recess of the frame link portion, wherein the frame link portion is attached or coupled to the frame element, within at least a portion of the coupling link opening, wherein the frame link portion includes a plurality of spaced apart frame link recess tabs, wherein each of the frame link recess tabs is separated by a frame link space, wherein the accessory link portion includes a plurality of spaced apart accessory link protrusion tabs, wherein each of the accessory link protrusion tabs is separated by an accessory link space, wherein corresponding accessory link protrusion tabs of the accessory link portion may be inserted within a corresponding recess of the frame link portion, and wherein the accessory link portion may be at least partially rotated relative to the frame link portion to engage corresponding accessory link protrusion tabs of the accessory link portion and frame link recess tabs of the frame link portion.

In various exemplary, non-limiting embodiments, the frame element includes a first leg and a second leg extending as an integral component of the central portion to the bottom of the frame element.

In various exemplary, non-limiting embodiments, the first leg and the second leg each extend away from one another.

In various exemplary, non-limiting embodiments, the frame element includes a first arm and a second arm extending as an integral component of the central portion to the top of the frame element.

In various exemplary, non-limiting embodiments, the first arm and the second arm each extend away from one another.

In various exemplary, non-limiting embodiments, a thickness of the central portion is greater than a thickness of the first leg, the second leg, the first arm, and/or the second arm.

In various exemplary, non-limiting embodiments, one or more portions of the backpack frame are formed of a substantially rigid material.

In various exemplary, non-limiting embodiments, a handle is attached or coupled to the frame element.

In various exemplary, non-limiting embodiments, a plurality of strap openings extend through the frame element proximate the one or more sides.

In various exemplary, non-limiting embodiments, a plurality of magnets is attached or coupled to the frame element proximate the rear surface of the frame element.

In various exemplary, non-limiting embodiments, each of the frame link recess tabs extends from a frame link sidewall of a frame link outer ring of the frame link portion and towards a proximate middle of the recess of the frame link portion.

In various exemplary, non-limiting embodiments, a number of the spaced apart frame link recess tabs corresponds to a number of the spaced apart accessory link protrusion tabs.

In various exemplary, non-limiting embodiments, the coupling link includes a plurality of rods inserted into a portion of the frame link portion of the coupling link.

In various exemplary, non-limiting embodiments, the frame link portion of the coupling link includes a frame link portion gap formed between each of the frame link recess tabs and the frame link base of the frame link portion, wherein each frame link portion gap is configured to receive a portion of a corresponding accessory link protrusion tab of the accessory link portion of the coupling link.

In various exemplary, non-limiting embodiments, the accessory link portion of the coupling link includes an accessory link gap formed between each of the accessory link protrusion tabs and a portion of the accessory link portion, wherein each accessory link gap is configured to receive a portion of a corresponding frame link recess tab of the frame link portion of the coupling link.

In various exemplary, non-limiting embodiments, one or more disc springs are positioned between portions of the accessory link portion and the frame link portion.

In various exemplary, non-limiting embodiments, the backpack frame system of the present disclosure comprises at least some of a frame element having a front surface and a rear surface, wherein the frame element extends from an upper portion, from the upper portion to a central portion, and from the central portion to a lower portion, and wherein the frame element extends to one or more sides; and a coupling link, wherein the coupling link includes a frame link portion and an accessory link portion, wherein the accessory link portion includes at least one attachment portion, which provides one or more areas, portions, or devices for attaching or coupling a load or other device the accessory link portion, wherein the accessory link portion includes a protrusion configured to fit at least partially within a recess of the frame link portion, wherein the frame link portion is integrally formed within a portion of the frame element as an integral part or component of the frame element, wherein the frame link portion includes a plurality of spaced apart frame link recess tabs, wherein each of the frame link recess tabs is separated by a frame link space, wherein the accessory link portion includes a plurality of spaced apart accessory link protrusion tabs, wherein each of the accessory link protrusion tabs is separated by an accessory link space, wherein corresponding accessory link protrusion tabs of the accessory link portion may be inserted within a corresponding recess of the frame link portion, and wherein the accessory link portion may be at least partially rotated relative to the frame link portion to engage corresponding accessory link protrusion tabs of the accessory link portion and frame link recess tabs of the frame link portion.

In various exemplary, non-limiting embodiments, the frame element includes a first leg and a second leg extending as an integral component of the central portion to the lower portion of the frame element, wherein the first leg and the second leg each extend away from one another, wherein the frame element includes a first arm and a second arm extending as an integral component of the central portion to the upper portion of the frame element, and wherein the first arm and the second arm each extend away from one another.

In various exemplary, non-limiting embodiments, the backpack frame system of the present disclosure comprises at least some of a frame element, wherein the frame element includes a central portion, wherein the frame element extends to one or more sides, and wherein a coupling link opening is formed within a portion of the central portion; and a coupling link, wherein the coupling link includes a frame link portion and an accessory link portion, wherein the accessory link portion includes at least one attachment portion, which provides one or more areas, portions, or devices for attaching or coupling a load or other device the accessory link portion, wherein the frame link portion is attached or coupled to the frame element, within at least a portion of the coupling link opening, wherein the frame link portion includes a plurality of spaced apart frame link recess tabs, wherein each of the frame link recess tabs is separated by a frame link space, wherein the accessory link portion includes a plurality of spaced apart accessory link protrusion tabs, wherein each of the accessory link protrusion tabs is separated by an accessory link space, wherein corresponding accessory link protrusion tabs of the accessory link portion may be inserted within a corresponding recess of the frame link portion, and wherein the accessory link portion may be at least partially rotated relative to the frame link portion to engage corresponding accessory link protrusion tabs of the accessory link portion and frame link recess tabs of the frame link portion.

In various exemplary, non-limiting embodiments, the frame element includes a first leg and a second leg extending as an integral component of the central portion, wherein the first leg and the second leg each extend away from one another, wherein the frame element includes a first arm and a second arm extending as an integral component of the central portion, and wherein the first arm and the second arm each extend away from one another.

Accordingly, the backpack frame system of the present disclosure separately and optionally provides a quick-release coupling link.

The backpack frame system of the present disclosure separately and optionally provides a backpack frame system, which is capable of retaining and attached or coupled item securely in the backpack frame system while permitting a release of the attached or coupled item when the user desires.

The backpack frame system of the present disclosure separately and optionally provides a backpack frame system, which is simple to operate.

The backpack frame system of the present disclosure separately and optionally provides a backpack frame system having increased modular functionality.

The presently disclosed systems, methods, and/or apparatuses separately and optionally provide a backpack frame system that can be easily manipulated by a user for repeatable attachment or coupling of a wide variety of loads.

These and other aspects, features, and advantages of the presently disclosed systems, methods, and/or apparatuses are described in or are apparent from the following detailed description of the exemplary, non-limiting embodiments of the presently disclosed systems, methods, and/or apparatuses and the accompanying figures. Other aspects and features of embodiments of the presently disclosed systems, methods, and/or apparatuses will become apparent to those of ordinary skill in the art upon reviewing the following description of specific, exemplary embodiments of the presently disclosed systems, methods, and/or apparatuses in concert with the figures. While features of the presently disclosed systems, methods, and/or apparatuses may be discussed relative to certain embodiments and figures, all embodiments of the presently disclosed systems, methods, and/or apparatuses can include one or more of the features discussed herein. Further, while one or more embodiments may be discussed as having certain advantageous features, one or more of such features may also be used with the various embodiments of the systems, methods, and/or apparatuses discussed herein. In similar fashion, while exemplary embodiments may be discussed below as device, system, or method embodiments, it is to be understood that such exemplary embodiments can be implemented in various devices, systems, and methods of the presently disclosed systems, methods, and/or apparatuses.

Any benefits, advantages, or solutions to problems that are described herein with regard to specific embodiments are not intended to be construed as a critical, required, or essential feature(s) or element(s) of the presently disclosed systems, methods, and/or apparatuses of the claims.

BRIEF DESCRIPTION OF THE SEVERAL VIEWS OF THE DRAWINGS

As required, detailed exemplary embodiments of the presently disclosed systems, methods, and/or apparatuses are disclosed herein; however, it is to be understood that the disclosed embodiments are merely exemplary of the presently disclosed systems, methods, and/or apparatuses that may be embodied in various and alternative forms, within the scope of the presently disclosed systems, methods, and/or apparatuses. The figures are not necessarily to scale; some features may be exaggerated or minimized to illustrate details of particular components. Therefore, specific structural and functional details disclosed herein are not to be interpreted as limiting, but merely as a basis for the claims and as a representative basis for teaching one skilled in the art to employ the presently disclosed systems, methods, and/or apparatuses.

The exemplary embodiments of the presently disclosed systems, methods, and/or apparatuses will be described in detail, with reference to the following figures, wherein like reference numerals refer to like parts throughout the several views, and wherein.

DETAILED DESCRIPTION OF EXEMPLARY EMBODIMENTS OF THE PRESENT DISCLOSURE

Figure 1:
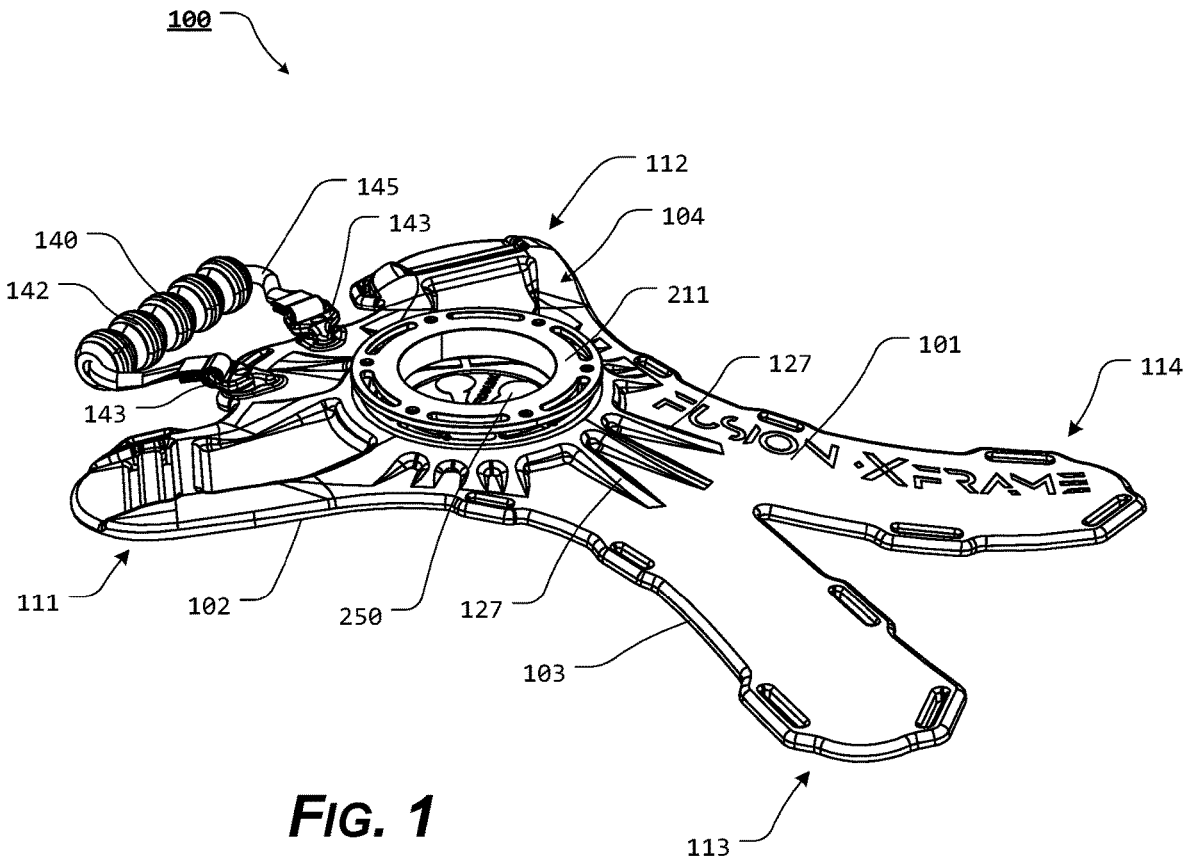
FIG. 1 illustrates a front, perspective view of an exemplary embodiment of a backpack frame system, according to the present disclosure.
Figure 2:
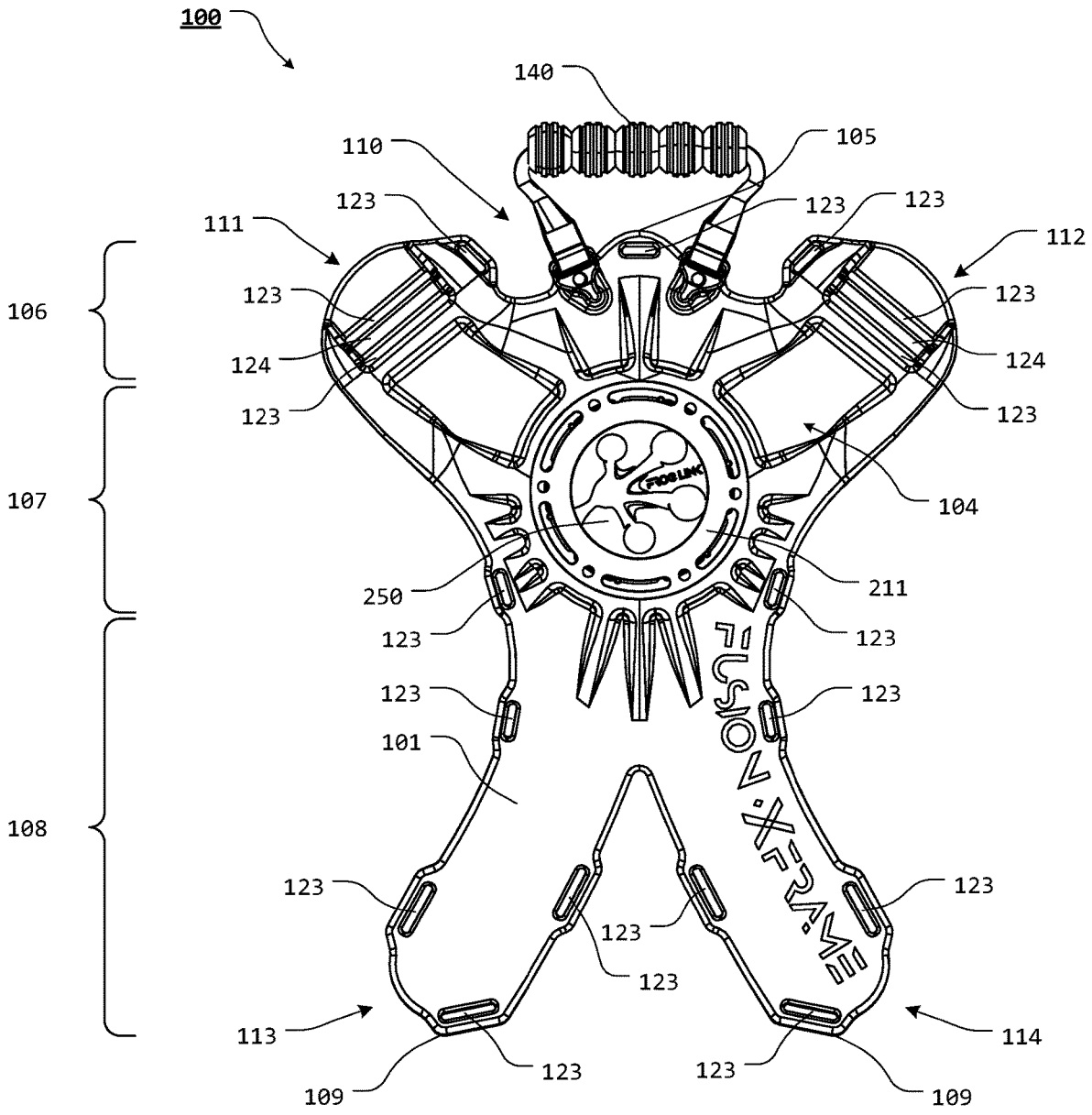
FIG. 2 illustrates a front view of an exemplary embodiment of a backpack frame system, according to the present disclosure.
Figure 3:
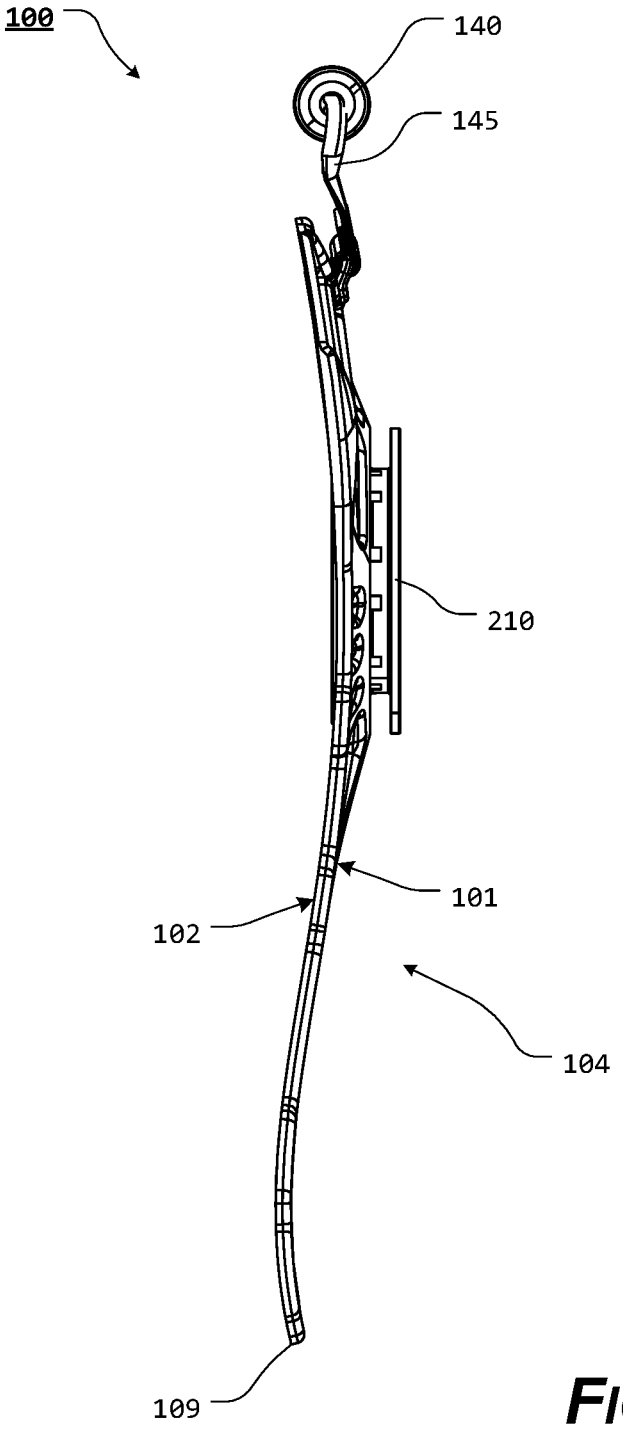
FIG. 3 illustrates a side view of an exemplary embodiment of a backpack frame system, according to the present disclosure.
Figure 4:
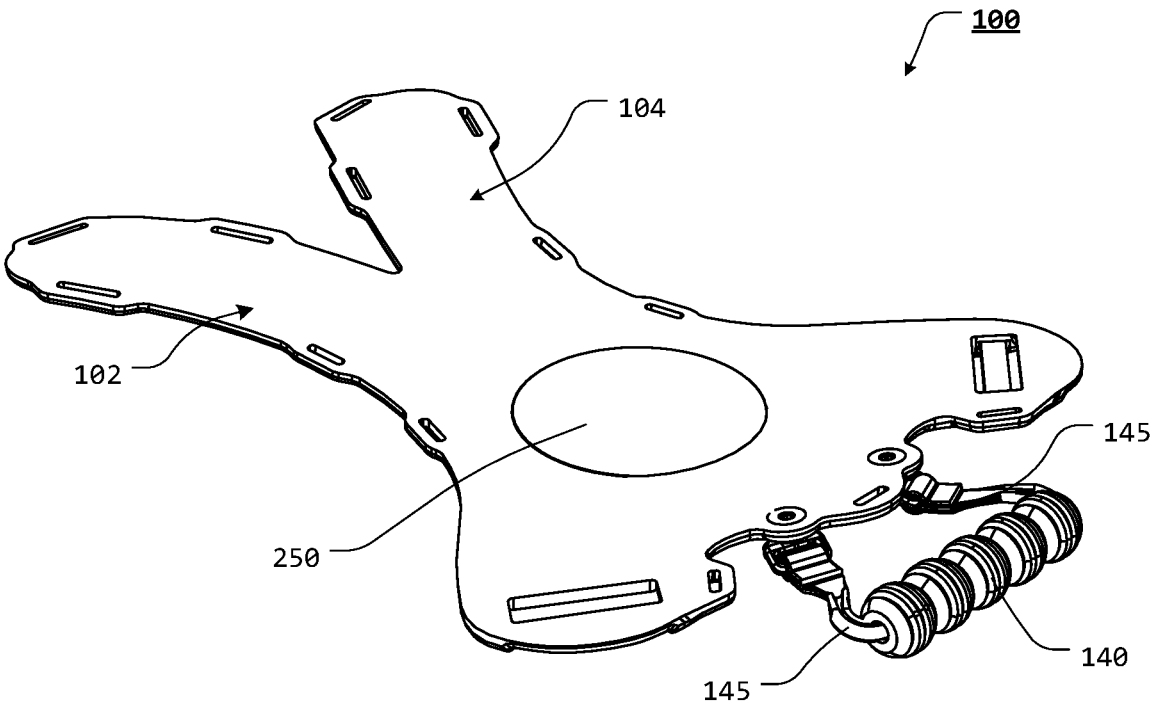
FIG. 4 illustrates a rear, perspective view of an exemplary embodiment of a backpack frame system, according to the present disclosure.
Figure 5:
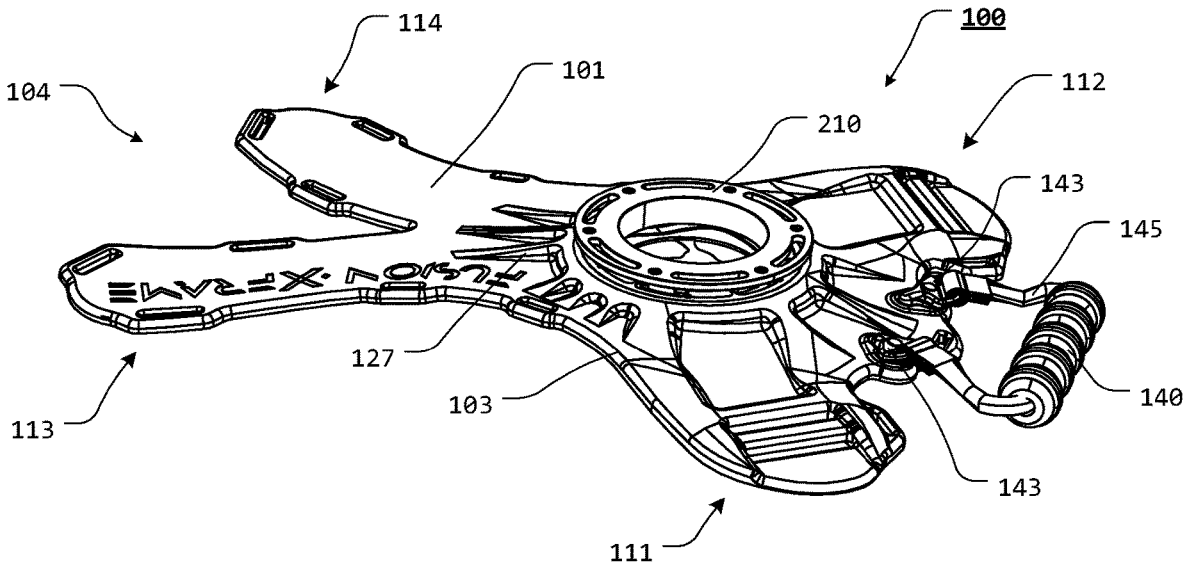
FIG. 5 illustrates a side, perspective view of an exemplary embodiment of a backpack frame system, according to the present disclosure.
Figure 6:
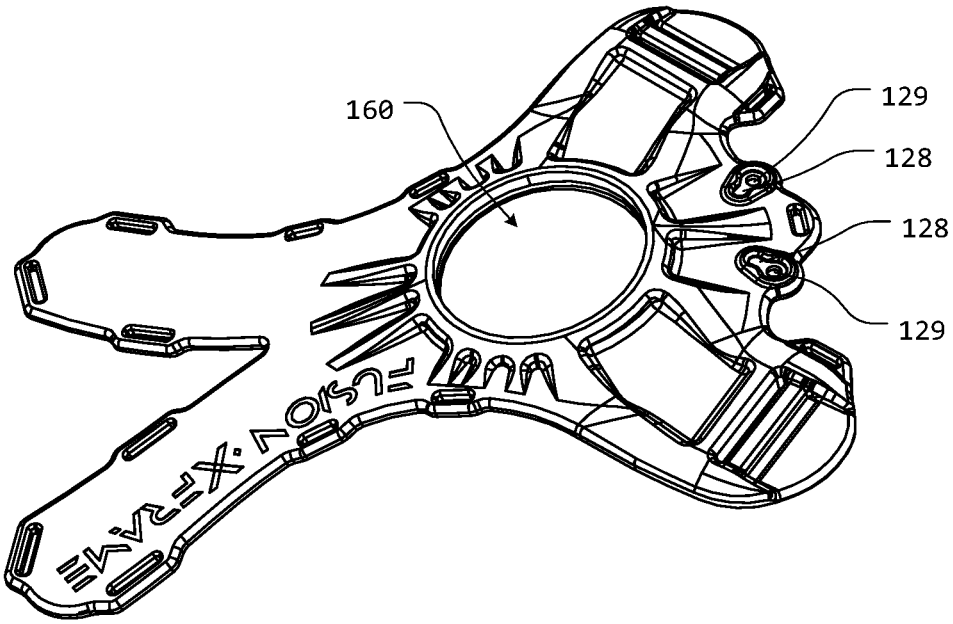
FIG. 6 illustrates a front, perspective view of an exemplary embodiment of a backpack frame system body, according to the present disclosure.

For simplicity and clarification, the design factors and operating principles of the backpack frame system according to the presently disclosed systems, methods, and/or apparatuses are explained with reference to various exemplary embodiments of a backpack frame system according to the presently disclosed systems, methods, and/or apparatuses. The basic explanation of the design factors and operating principles of the backpack frame system is applicable for the understanding, design, and operation of the backpack frame system of the presently disclosed systems, methods, and/or apparatuses. It should be appreciated that the backpack frame system can be adapted to many applications where a backpack frame system can be used.

As used herein, the word "may" is meant to convey a permissive sense (i.e., meaning "having the potential to"), rather than a mandatory sense (i.e., meaning "must"). Unless stated otherwise, terms such as "first" and "second", "right" and "left", "front" and "rear", "top" and "bottom", "upper" and "lower", and "horizontal" and "vertical" are used as a naming convention to arbitrarily distinguish between the exemplary embodiments and/or elements such terms describe. Thus, these terms are not necessarily intended to indicate temporal or other prioritization of such exemplary embodiments and/or elements but are used to help differentiate between certain of the components of the present disclosure and are not to be construed as limiting the present disclosure.

As used herein, and unless the context dictates otherwise, the term "coupled" is intended to include both direct coupling (in which two elements that are coupled to each other contact each other) and indirect coupling (in which at least one additional element is located between the two elements). The term coupled, as used herein, is defined as connected, although not necessarily directly, and not necessarily mechanically. The terms "a" and "an" are defined as one or more unless stated otherwise.

The terms "comprise" (and any form of comprise, such as "comprises" and "comprising"), "have" (and any form of have, such as "has" and "having"), "include", (and any form of include, such as "includes" and "including") and "contain" (and any form of contain, such as "contains" and "containing") are used as open-ended linking verbs. It will be understood that these terms are meant to imply the inclusion of a stated element, integer, step, or group of elements, integers, or steps, but not the exclusion of any other element, integer, step, or group of elements, integers, or steps. As a result, a system, method, device, and/or apparatus that "comprises", "has", "includes", or "contains" one or more elements possesses those one or more elements but is not limited to possessing only those one or more elements. Similarly, a method or process that "comprises," "has," "includes" or "contains" one or more operations possesses those one or more operations but is not limited to possessing only those one or more operations.

It should also be appreciated that, for simplicity and clarification, the embodiments of the present disclosure will be described using the terms "front" and "back". However, it should be understood that these terms are merely used to aid in understanding of the present disclosure are not to be construed as limiting the systems, methods, devices, and/or apparatuses of the present disclosure. Thus, it should be appreciated that the design factors and operating principles of the plate carrier described herein may be used in a "mirror image" plate carrier, where in the elements described as being included in or on the front carrier are included in or on the rear or back carrier. Alternatively, certain of the elements that are described as being included in or on the back of the plate carrier may be included in or on the front of the plate carrier, or vice versa.

Furthermore, it should be appreciated that, for simplicity and clarification, the embodiments of the present disclosure will be shown and/or described with reference to one or more attachment arrays being included on various portions of the plate carrier. However, it should be appreciated that the inclusion and/or placement of any passion array is not essential to the plate carrier of the present disclosure. In various exemplary, non-limiting embodiments of the present disclosure, the plate carrier may incorporate any type of known or later developed system capable of allowing any number of exterior pouches, pockets, carriers, or the like to be permanently or releasably coupled or attached to the plate carrier. Alternatively, the design factors and principles of the present disclosure may be utilized in a plate carrier that does not include any attachment array, exterior pouches, pockets, or carriers, but is used as, for example, a ballistic plate carrier or a floatation device.

It should also be appreciated that the terms "backpack", "backpack frame system", and "frame system" are used for a basic explanation and understanding of the operation of the systems, methods, and apparatuses of this invention. Therefore, the terms "backpack", "backpack frame system", and "frame system" are not to be construed as limiting the systems, methods, and apparatuses of this invention.

Furthermore, it should be appreciated that, for simplicity and clarification, the embodiments of this invention will be described with reference to a backpack frame system of the present disclosure having a coupling link and a frame link of a particular size and shape. However, it should be appreciated that the operating principles of the disclosed backpack frame system may also be employed to construct backpack frame systems having a coupling link and/or frame length of a different size or shape. Furthermore, it is also within the scope of the present invention that the present backpack frame system may be employed as a frame assembly for tactical accessories or for everyday items such as hiking equipment.

Turning now to the appended drawing figures, FIGS. 1-21 illustrate certain elements and/or aspects of an illustrative, non-limiting embodiment of a backpack frame system 100 according to the present disclosure. As illustrated in FIGS. 1-21, the backpack frame system 100 is generally configured to be coupled to a user's back so as to enable the user to carry various items. Particular implementations also include universal frame systems. As used herein, "universal" refers to the ability of the frame element 104 to couple to varying types of loads to be carried.

Any of the implementations of the backpack frame systems 100 disclosed herein may be the same as or similar to any backpack frame system 100 or element thereof of the backpack frame system 100, the disclosure of which is incorporated entirely herein by reference.

In various exemplary, nonlimiting embodiments, the backpack frame system 100 includes at least some of a frame element 104 and a coupling link 210. The frame element 104 includes a front surface 101 and a rear surface 102 and extends from a top 105 to a bottom 109 and extends to sides 103.

As used herein, front surface 101 is used to generally describe the portion of the frame element 104 facing away from a user when the frame element 104 is worn on a user's back, rear surface 102 is used to describe the portion of the frame element 104 facing the user's back when the frame element 104 is worn on the back of a user, top 105 is used to describe the portion of the frame element 104 closest to a user's head when the frame element 104 is worn on the user's back and the user is standing, bottom 109 is used to describe the portion of the frame element 104 closest to the user's waist when the frame element 104 is worn on the back of a user and the user is in a standing position, and side 103 or sides 103 are used to describe the portions of the frame element 104 between the top 105 and bottom 109 and the front surface 101 and the rear surface 102 and corresponding to the sides of a user when the frame element 104 is worn on the user's back.

In various exemplary, nonlimiting embodiments, the frame element 104 extends from an upper portion 106, through a central portion 107, to a lower portion 108. In various implementations the frame element 104 may either include a coupling link 210 or be configured to directly couple to a coupling link 210. The central portion 107 may be configured to cover a portion of a user's upper back (which may include the trapezius of the user) and/or a portion of a user's middle back (which may include the user's latissimus dorsi).

In various exemplary, nonlimiting embodiments, the frame element 104 includes a first leg 113 and a second leg 114 extending as an integral unit from the central portion 107. The first leg 113 and second leg 114 may extend from the central portion 107 to the bottom 109 of the frame element 104. As illustrated, in various implementations of the present disclosure, each first leg 113 and second leg 114 extends away from one another and towards the sides of the user when the frame element 104 is worn on the user' back. The first leg 113 and second leg 114 may be configured to span across portions of the user's middle back and/or lower back (which may include the user's erector spinae).

In various exemplary, nonlimiting embodiments, the lower portion 108 of the frame element 104 may not include the first leg 113 and second leg 114 but may include a single piece configured to cover portions of the user's lower and/or middle back. The lower portion 108 may include any type of shape, size, and/or design.

In various implementations of the present disclosure, the frame element 104 may optionally include a first arm 111 and a second arm 112 extending as an integral component of the central portion 107 of the frame element 104. The first arm 111 and the second arm 112 may extend from the central portion 107 to the top 105 of the frame element 104. As illustrated, in various implementations of the present disclosure, the first arm 111 and the second arm 112 each extend away from one another and towards the sides of a user when the frame element 104 is on the user's back. The first arm 111 and the second arm 112 may be configured to span across a portion of the user's upper back.

In various exemplary, nonlimiting embodiments, the upper portion 106 of the frame element 104 may not include the first arm 111 and the second arm 112 but may include a single piece configured to cover portions of the user's upper back. The upper portion 106 may include any type of shape, size, and/or design.

In various implementations of the present disclosure, the first arm 111 and the second arm 112 and the first leg 113 and the second leg 114 of the frame element 104 may form a substantially "X" shaped frame element 104. In various exemplary, nonlimiting embodiments, frame element 104 may include other designs and/or shapes.

In various implementations of the present disclosure, the frame element 104 may include a head portion 110 extending from the central portion 107 towards the top 105 of the frame element 104. The head portion 110 may optionally be positioned between the first arm 111 and the second arm 112. In such implementations, the head portion 110 may cover and protect an upper portion 106 of the user's spine.

As illustrated, a thickness of the central portion 107 may be greater than a thickness of the first leg 113 and/or the second leg 114 and/or a thickness of the first arm 111 and the second arm 112. As illustrated, the increased thickness of the central portion 107 may include one or more ridges 127 on the front surface 101 of the frame element 104. In such implementations, the increased thickness and/or the ridges 127 may increase the stability and structural integrity of the frame element 104.

In various implementations of the present disclosure, the curvature of the frame element 104, including the curvature of the rear surface 102 of the frame element 104, may generally correspond to the curvature of a user's back. In various exemplary, nonlimiting embodiments, the frame element 104 may include any other type of curvature.

In various exemplary, nonlimiting embodiments, the frame element 104 may be predominantly solid. In various exemplary, nonlimiting embodiments, the frame element 104 may include a plurality of openings 129 in any of the first leg 113 and the second leg 114, the middle of the first leg 113 and the second leg 114, the central portion 107, the first arm 111, the second arm 112, the middle the first arm 111, the second arm 112, and/or the middle of the central portion 107. In such implementations, the plurality of openings 129 may reduce the weight of the overall frame element 104.

In various implementations of the present disclosure, the frame element 104 may be made from, by non-limiting example, a metallic material, a composite material, a carbon based material, a polymer, or any other rigid material. In certain particular implementations, the frame element 104 may be made from carbon, Kevlar, aluminum, or any other rigid material. In implementations including carbon or Kevlar, the frame element 104 may include bulletproof/blastproof properties and may serve as a shield of protection to the user when wearing the frame element 104.

In various exemplary, nonlimiting embodiments, one or more portions of the backpack frame system 100 may be formed of a substantially rigid material, such as, for example, a polymeric material or a polymeric composite. Alternate materials of construction may include one or more of the following: steel, aluminum, titanium, and/or other metals, as well as various alloys and composites thereof, glass-hardened polymers, polymer or fiber reinforced metals, carbon fiber or glass fiber composites, continuous fibers in combination with thermoset and thermoplastic resins, chopped glass or carbon fibers used for injection molding compounds, laminate glass or carbon fiber, epoxy laminates, woven glass fiber laminates, impregnate fibers, polyester resins, epoxy resins, phenolic resins, polyimide resins, cyanate resins, high-strength plastics, nylon, glass, or polymer fiber reinforced plastics, thermoform and/or thermoset sheet materials, or the like, and/or various combinations of the foregoing.

In various exemplary embodiments, at least certain components of the backpack frame system 100 may be formed of any known or later developed, substantially flexible material(s) such as a polymeric material, leather, foam, foam laminates, natural and man-made (synthetic) fabrics, natural and man-made (synthetic) fabric laminates, moldable honeycomb materials, or the like, and/or various combinations of the foregoing.

In various exemplary embodiments, a mold may optionally be configured to be used to make or formed the frame element 104. In various implementations of the present disclosure, the frame element 104 may include a single unitary piece. In various exemplary, nonlimiting embodiments, the frame element 104 may include separate pieces fixed or coupled together.

Thus, it should be understood that the material or materials used to form the backpack frame system 100 and/or various components of the backpack frame system 100 is a design choice based on the desired appearance and/or functionality of the backpack frame system 100.

In various exemplary embodiments, the frame element 104 may optionally include a handle 140. In implementations having a head portion 110, the handle 140 may be attached or coupled to the head portion 110. In various exemplary, nonlimiting embodiments not including a head portion 110, the handle 140 may be attached or coupled to any other portion of the frame element 104 that may include an upper portion 106 of the frame element 104. In various implementations of the present disclosure, the frame element 104 may include one or more depressions 128 each configured to receive a portion of the handle 140. In various implementations of the present disclosure, the frame element 104 may also include one or more openings 129 configured to receive an attachment mechanism configured to attach the handle 140 to the frame element 104. The attachment mechanisms may include, by non-limiting example, screws, bolts, rivets, or any other type of attachment mechanism.

Figure 7:
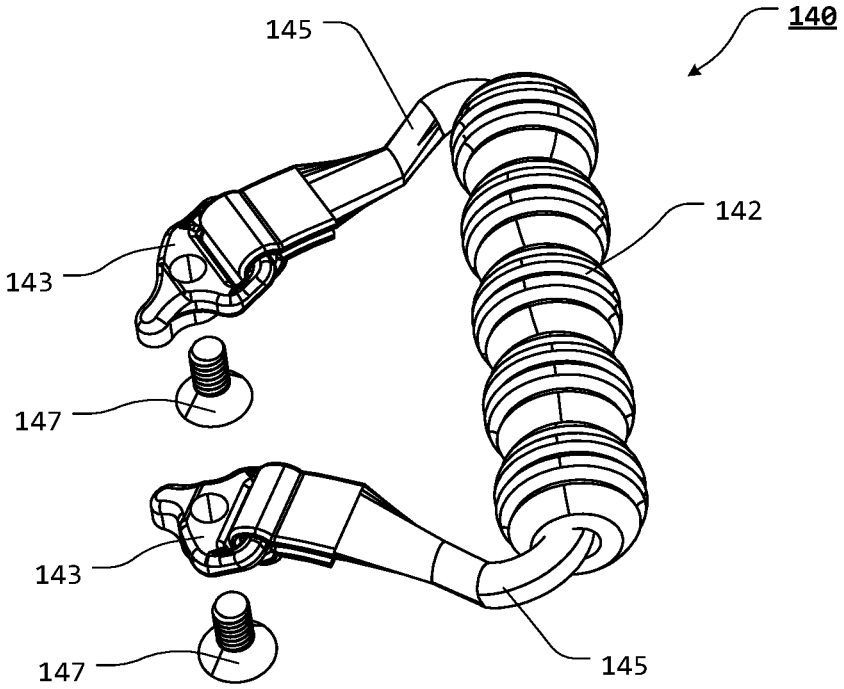
FIG. 7 illustrates a perspective view of an exemplary embodiment of a handle assembly, according to the present disclosure.

In various implementations of the present disclosure, the handle 140 may include one or more tabs 143 configured to be received by the one or more depressions 128 of the frame element 104. FIG. 7 illustrates the handle 140, the tabs 143, a strap 145, an exemplary fastening elements 147, configured to attach or couple to the tab 143 two frame element 104. In various implementations of the present disclosure, the tab 143 of the handle 140 may include an opening extending therethrough and configured to receive a strap 145 of the handle 140. A ridge may optionally be formed by a portion of the strap 145 of the handle 140 configured to be gripped by a user. In various implementations of the present disclosure, a plurality of beads 142 or other ergonomic grips may be coupled around the ridge of the handle 140 or the strap 145.

In various exemplary, nonlimiting embodiments, the handle 140 may include a single strap 145 with each end of the strap 145 attached or coupled to the frame element 104, via fasteners 147, or directly coupled to a tab 143, which is directly attached or coupled to the frame element 104. In still various exemplary, nonlimiting embodiments, the handle 140 may comprise an opening formed in the frame element 104, configured to be large enough to allow a user's hand to enter through the opening. In still various exemplary, nonlimiting embodiments, the frame element 104 may not include a handle 140.

The frame element 104 may optionally include a plurality of strap openings 123 extending through the frame element 104 proximate a perimeter of the frame element 104. In various implementations of the present disclosure, an end of each first leg 113 and second leg 114 and an end of each first arm 111 and second arm 112 may include one or more strap openings 123. The strap openings 123 are configured to receive a user attachment strap and/or harness in order to couple the frame element 104 to an external device, such as the back of a user.

In various implementations of the present disclosure, the frame element 104 may include a plurality of strap openings 123 along a perimeter of the frame element 104 in addition to the strap openings 123 proximate an end of each first arm 111 and second arm 112 and of each first leg 113 and second leg 114. In such implementations, the strap openings 123 may be configured to receive a user attachment strap and further secure or the frame element 104 to the back of a user and/or to a load attached to the frame element 104. In various implementations of the present disclosure, the strap openings 123 at the end of each of the first arm 111 and the second arm 112 may include a bar 124 therein. In such implementations, the strap 145 may be configured to be interwoven between the strap openings 123 and the bar 124, allowing the length of the strap 145 to be adjusted to provide for a proper fit to a user. It should be appreciated that any of the strap openings 123 may include a bar 124 therein.

While not illustrated, in various implementations the frame element 104 may optionally include one or more strap openings 123 set in from the perimeter or sides 103 of the frame element 104. The set-in strap openings 123 of the frame element 104 may be configured to receive a user attachment strap configured to further secure the frame element 104 to a user and/or a load.

Various portions of a frame element 104 include a plurality of strap openings 123. In certain implementations of the present disclosure, the frame element 104 may include a perimeter portion coupled along the perimeter or the sides 103 of the frame element 104. In such supplementations, a plurality of strap openings 123 may be formed between the perimeter portion and the remainder the frame element 104. In various supplementations, the frame element 104 may include additional strap openings 123 immediately set in from the plurality of strap openings 123 formed between the perimeter portion and the remainder of the frame element 104.

Though not illustrated, the implementations of the backpack frame systems 100 disclosed herein may include a plurality of user attachment straps or harnesses coupled to the frame element 104. In various implementations of the present disclosure, the user attachment straps or harness may include a diving/maritime style, a backpack style, a military style, a firefighting style, a climbing harness style, or any other type of user attachment strap or harness used for any other activity. In various implementations of the present disclosure, the backpack frame system 100 may include multiple user attachment strap types or multiple types of harnesses that can be swapped out depending on the particular use of the backpack frame system 100.

In various implementations of the present disclosure, though not illustrated, the rear surface 102 of the frame element 104 may include a pad coupled thereto and configured to be positioned between the frame element 104 and a user's back, when worn by the user. In various supplementations, the pad may be removably coupled to the frame element 104. In various exemplary, nonlimiting embodiments the pad may be non-removably coupled to the frame element 104. In implementations where the pad is removably coupled to the frame element 104, a variety of different types of pads may be coupled to the frame element 104 in order to customize the type of pad for the particular configured use of the frame element 104. In various implementations of the present disclosure, the pad may include, by non-limiting example, a silicon rubber, a neoprene rubber, leather, foam, cloth, a polymer, or any other material configured to offer padding to a user when the frame element 104 is worn by user.

Figure 8:
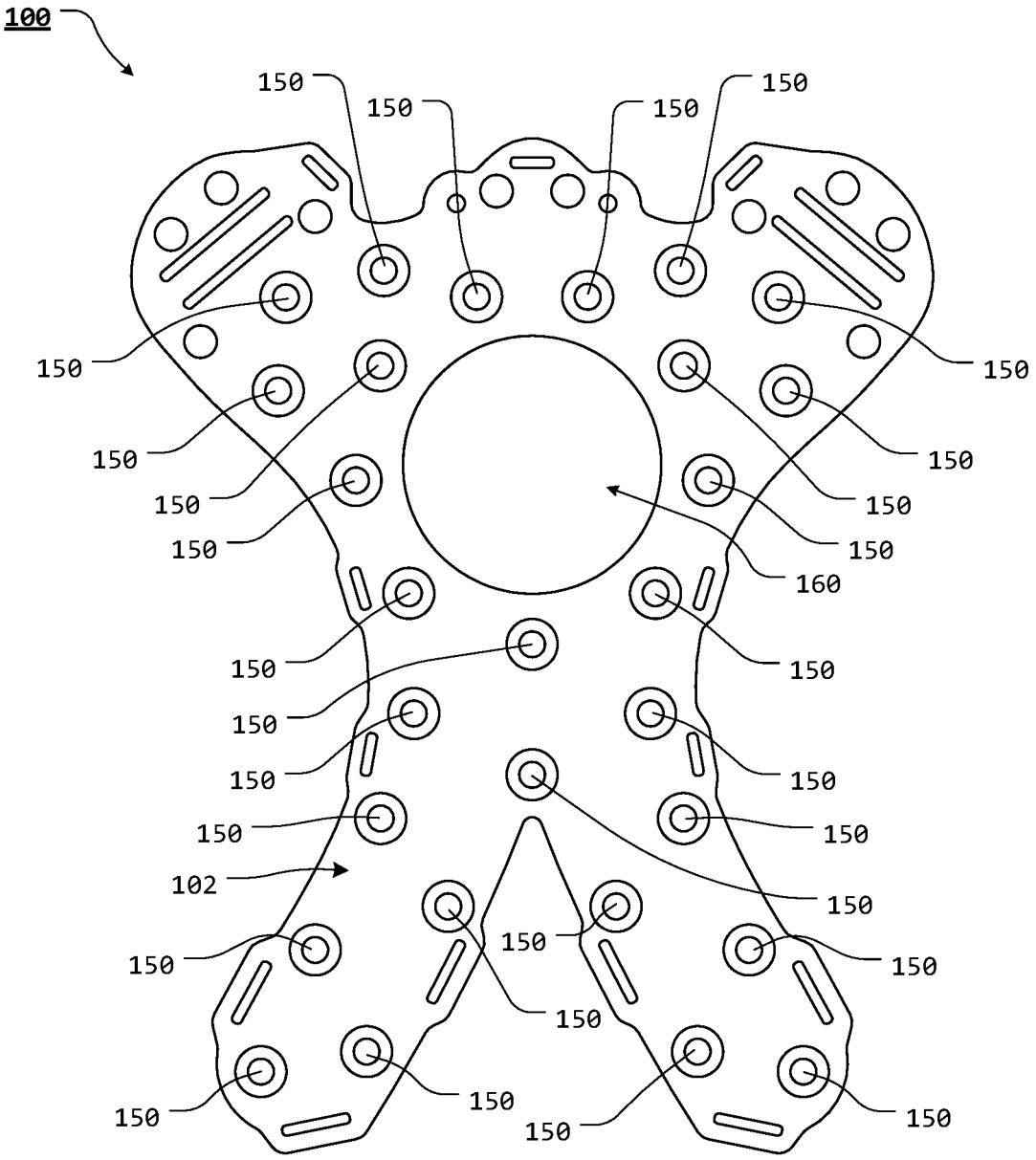
FIG. 8 illustrates a rear view of an exemplary embodiment of a backpack frame system body, according to the present disclosure.
Figure 9:
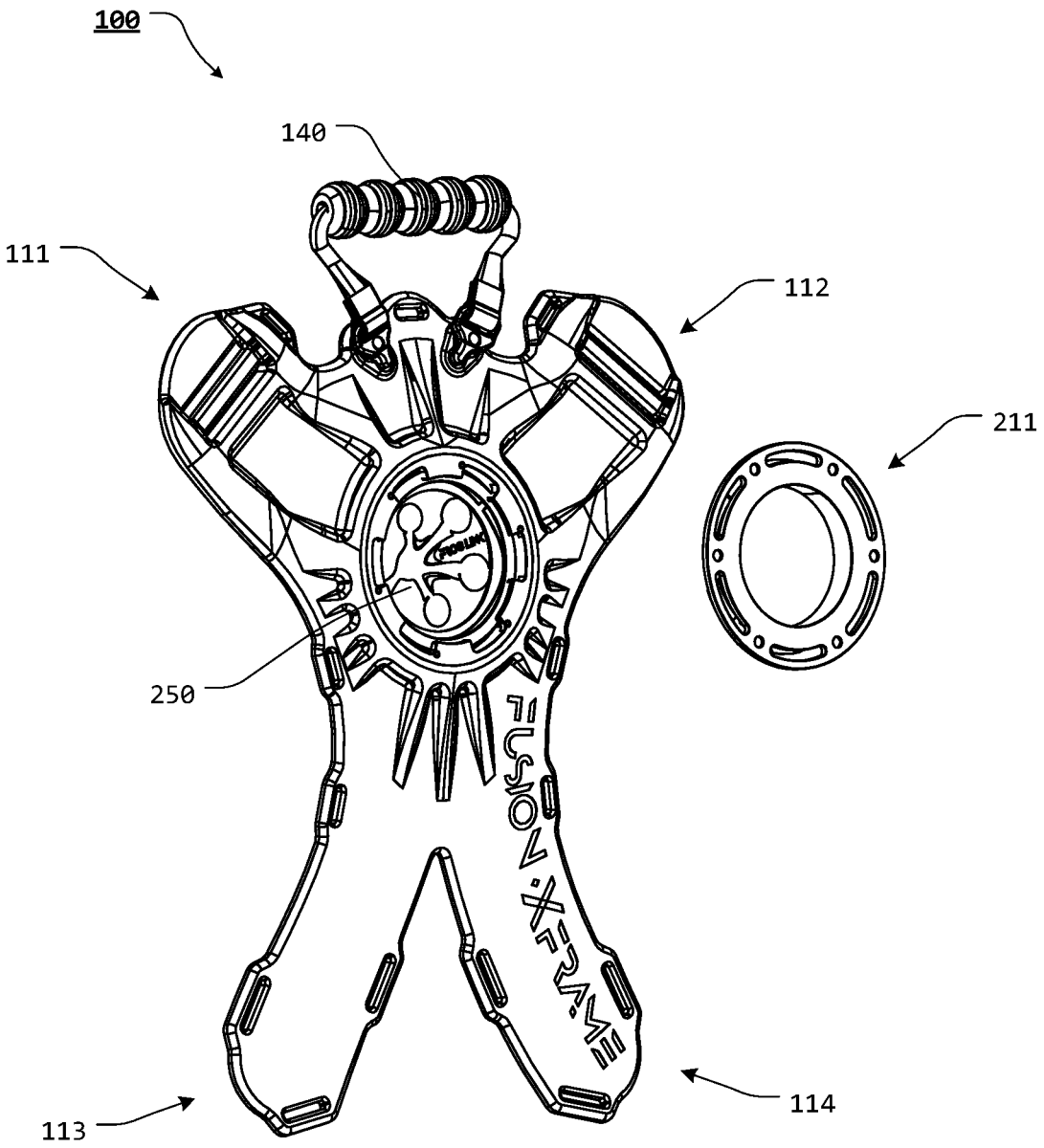
FIG. 9 illustrates a partially exploded front, perspective view of an exemplary embodiment of a backpack frame system, according to the present disclosure.
Figure 10:
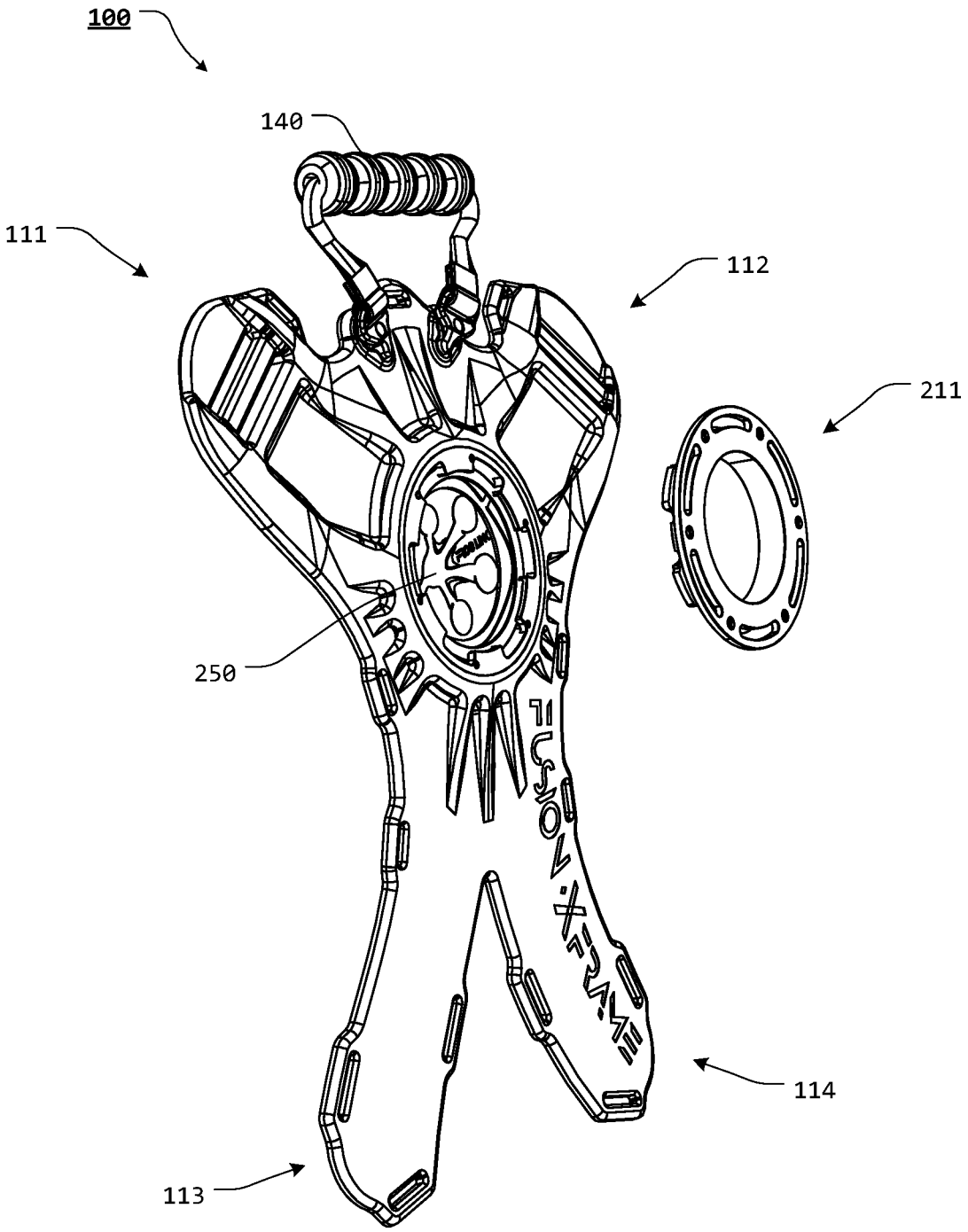
FIG. 10 illustrates a partially exploded front, perspective view of an exemplary embodiment of a backpack frame system, according to the present disclosure.
Figure 11:
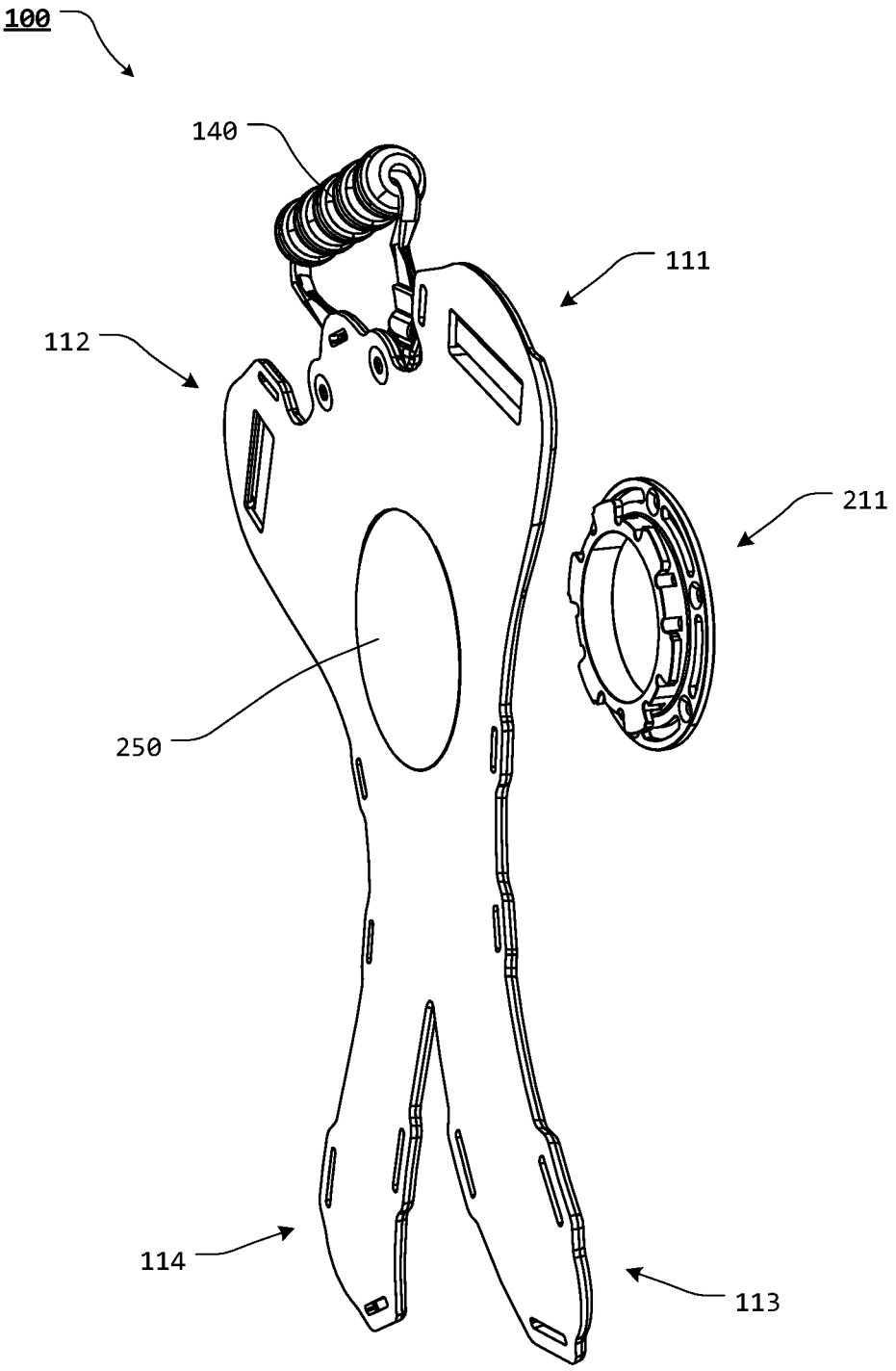
FIG. 11 illustrates a partially exploded rear, perspective view of an exemplary embodiment of a backpack frame system, according to the present disclosure.
Figure 12:
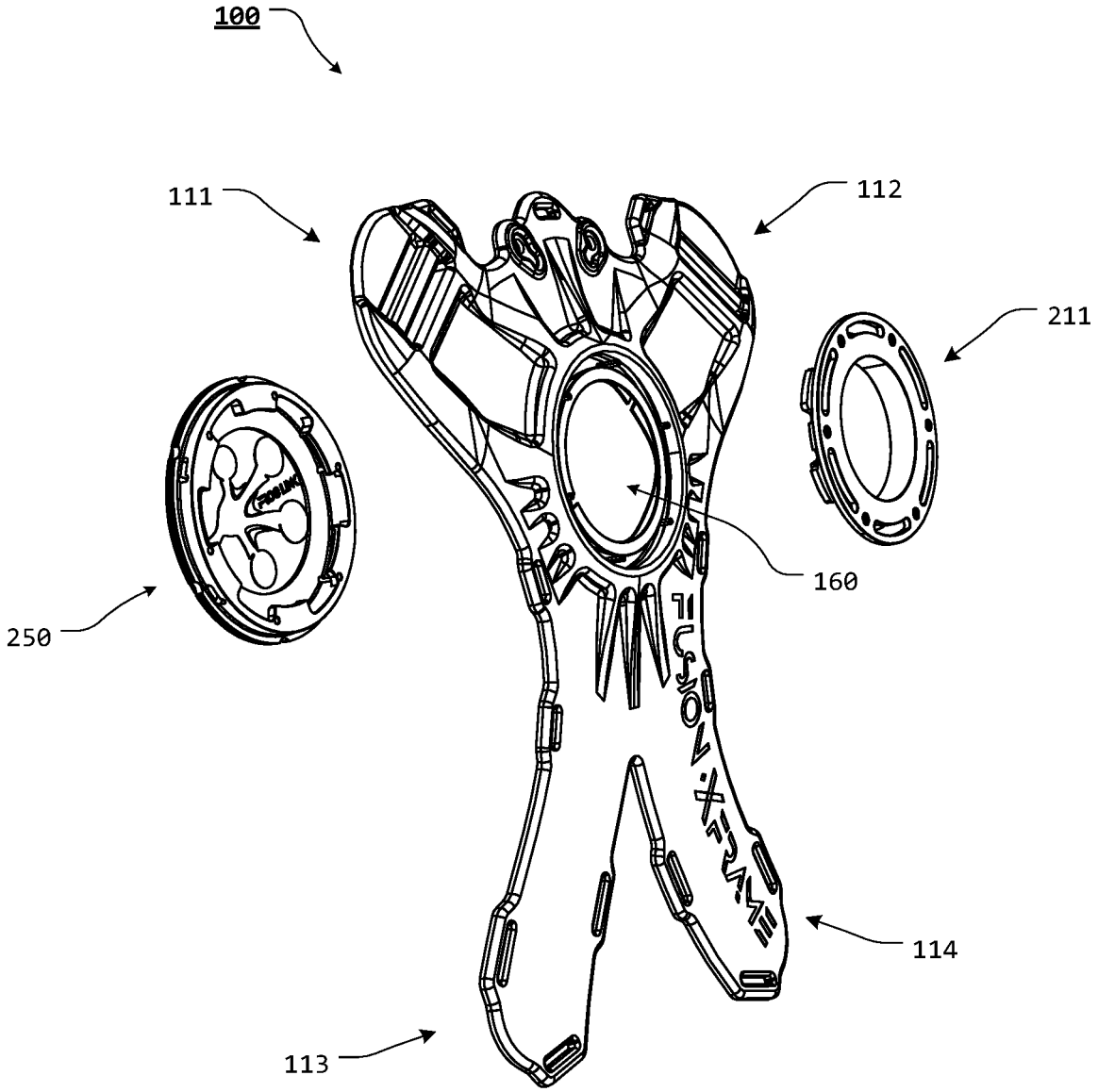
FIG. 12 illustrates a partially exploded front, perspective view of an exemplary embodiment of a backpack frame system, according to the present disclosure.
Figure 13:
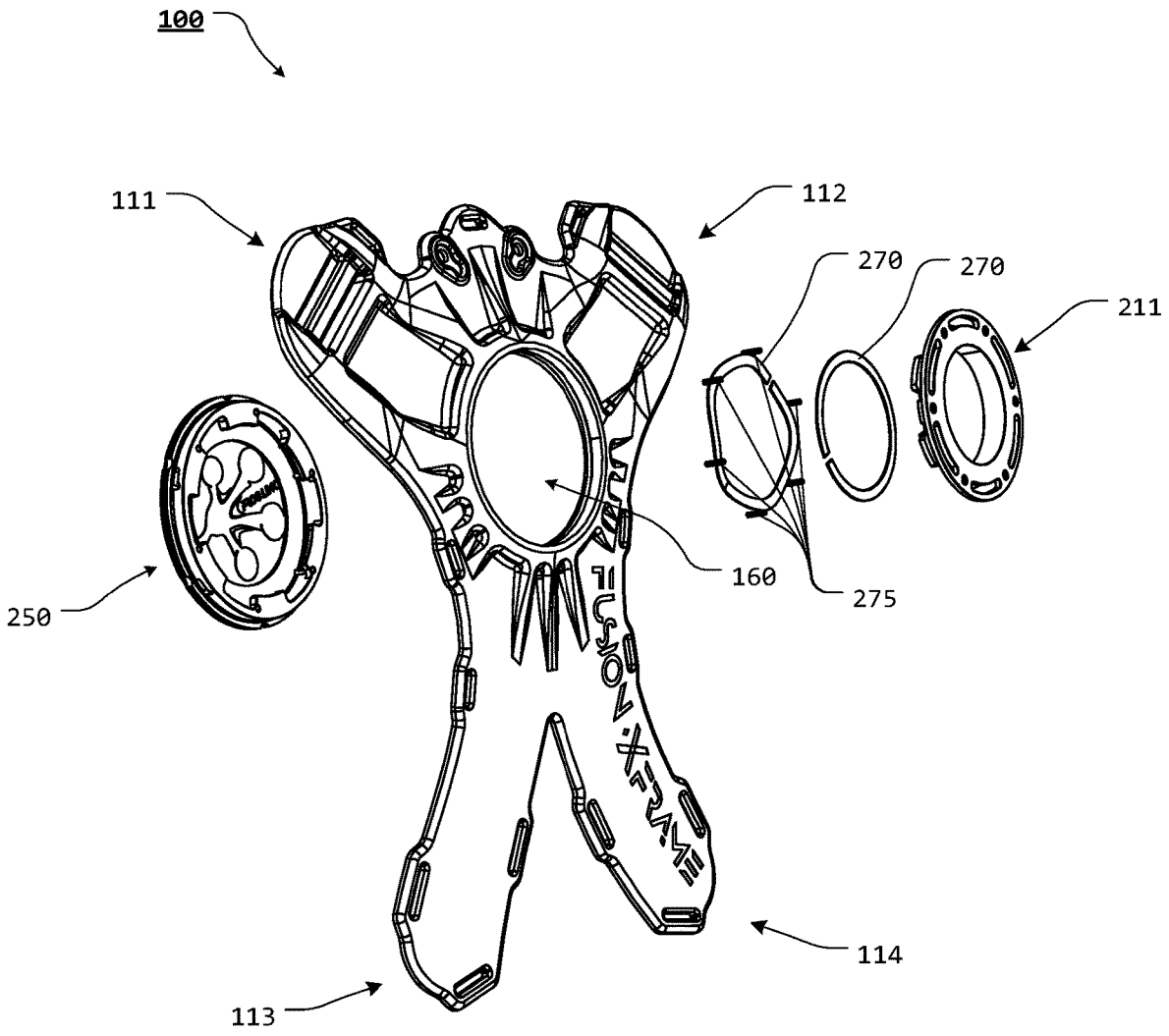
FIG. 13 illustrates a partially exploded front, perspective view of an exemplary embodiment of a backpack frame system, according to the present disclosure.
Figure 14:
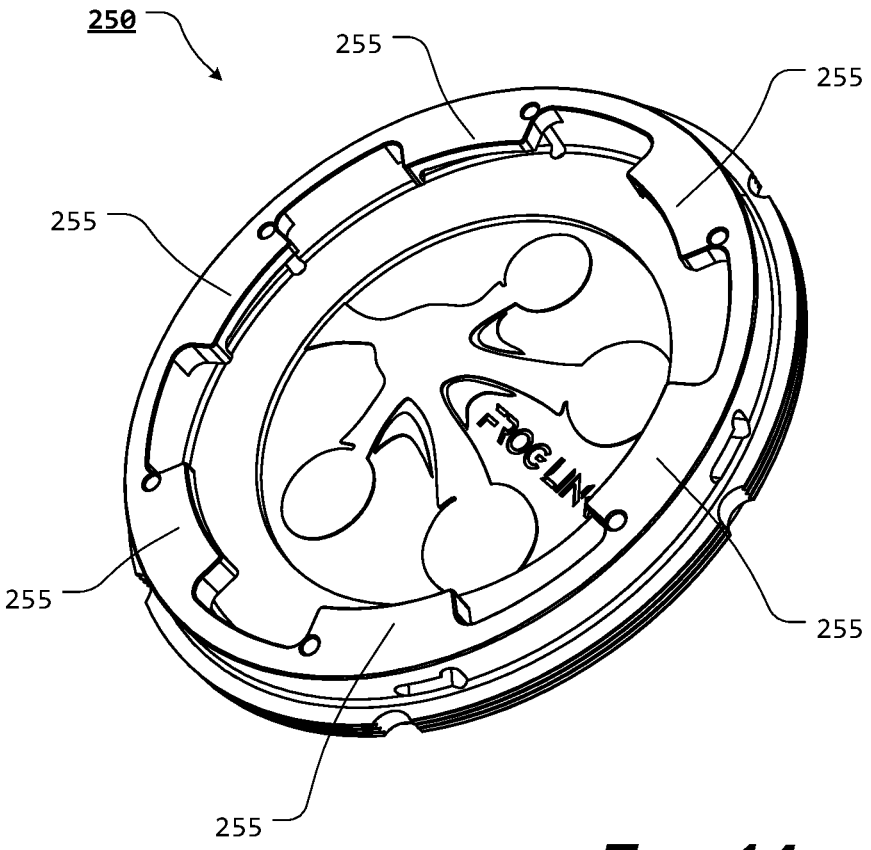
FIG. 14 illustrates an upper, front perspective view of an exemplary embodiment of a frame link portion, according to the present disclosure.
Figure 15:
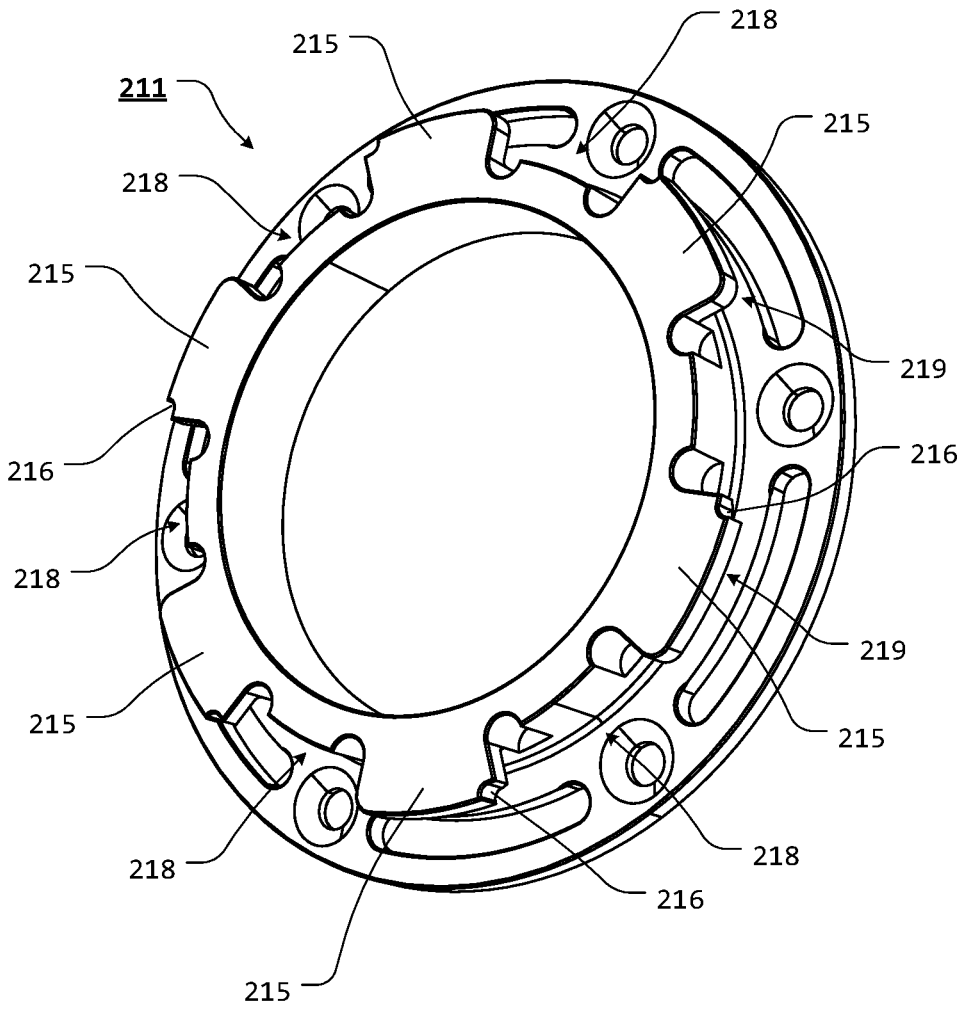
FIG. 15 illustrates an upper, front perspective view of an exemplary embodiment of an accessory link portion, according to the present disclosure.
Figure 16:
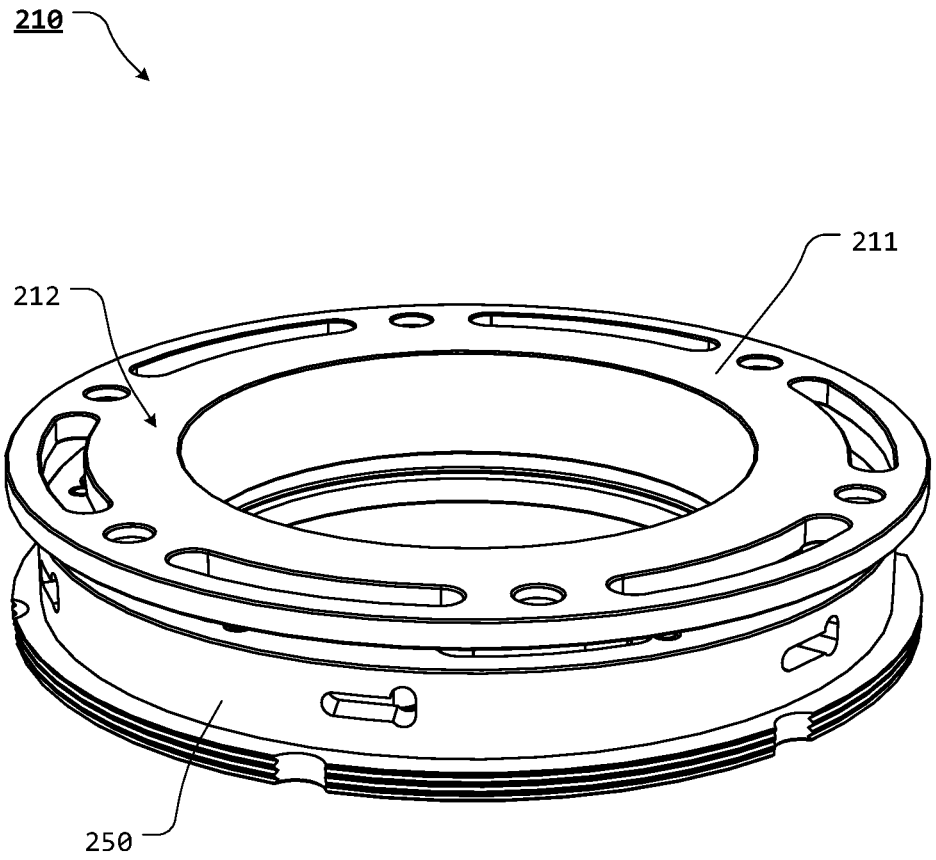
FIG. 16 illustrates an upper, front perspective view of an exemplary embodiment of a coupling link, according to the present disclosure.
Figure 17:
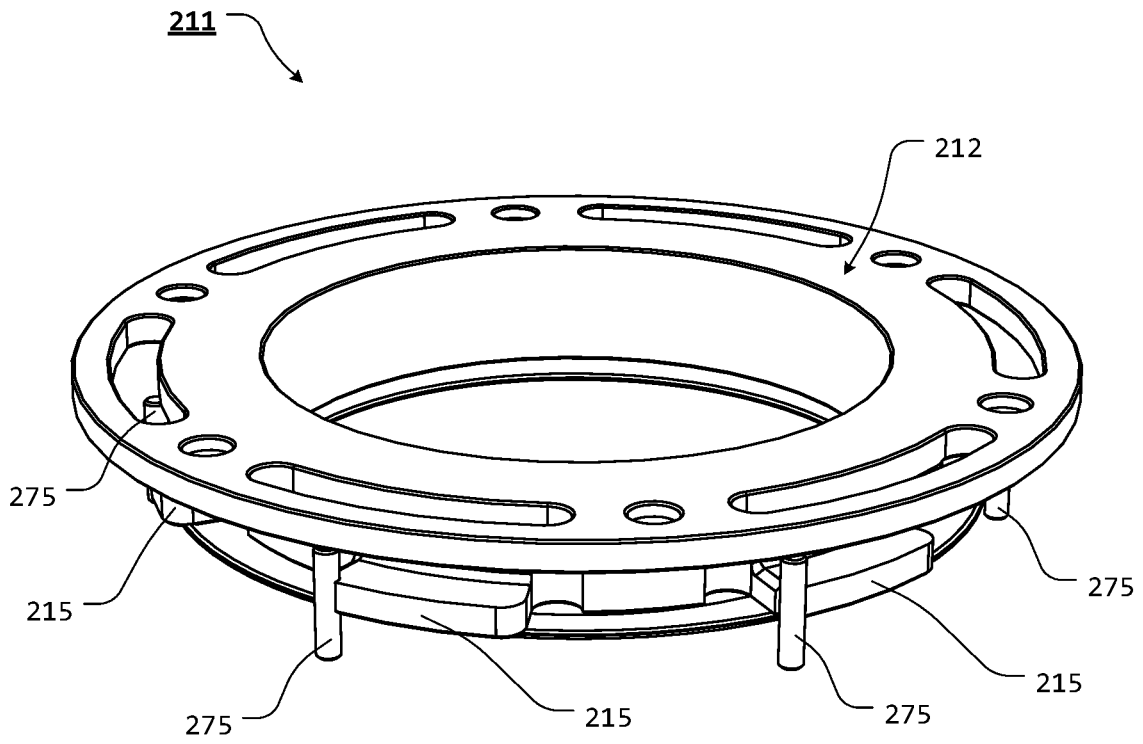
FIG. 17 illustrates an upper, front perspective view of an exemplary embodiment of an accessory link portion, according to the present disclosure.
Figure 18:
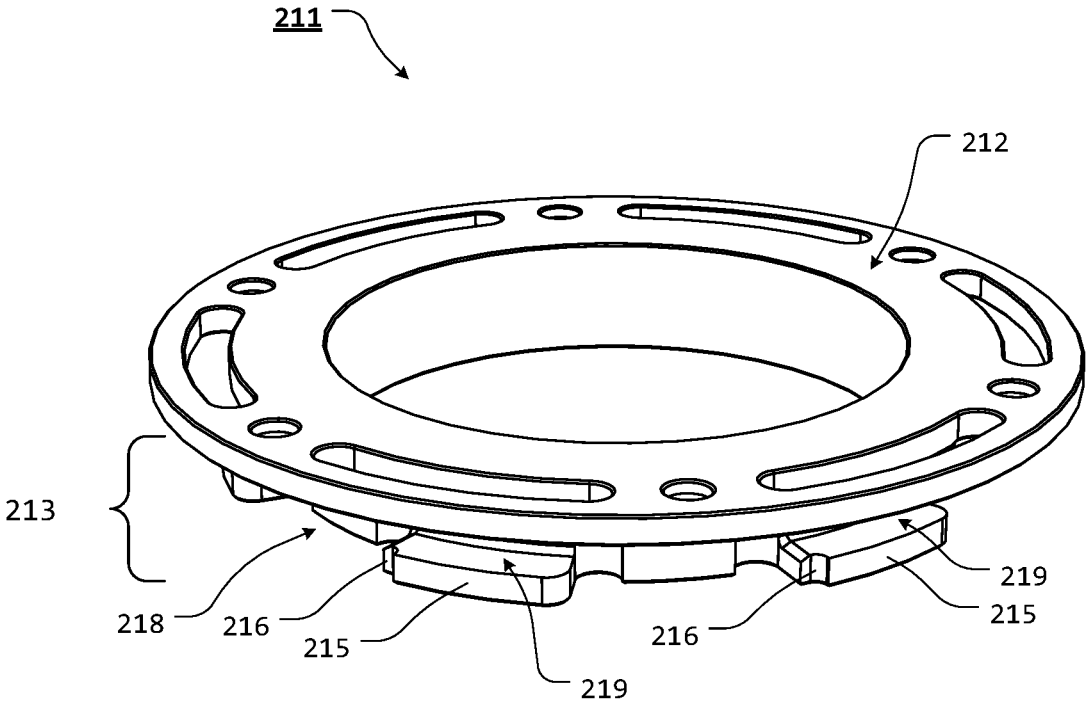
FIG. 18 illustrates an upper, front perspective view of an exemplary embodiment of an accessory link portion, according to the present disclosure.
Figure 19:
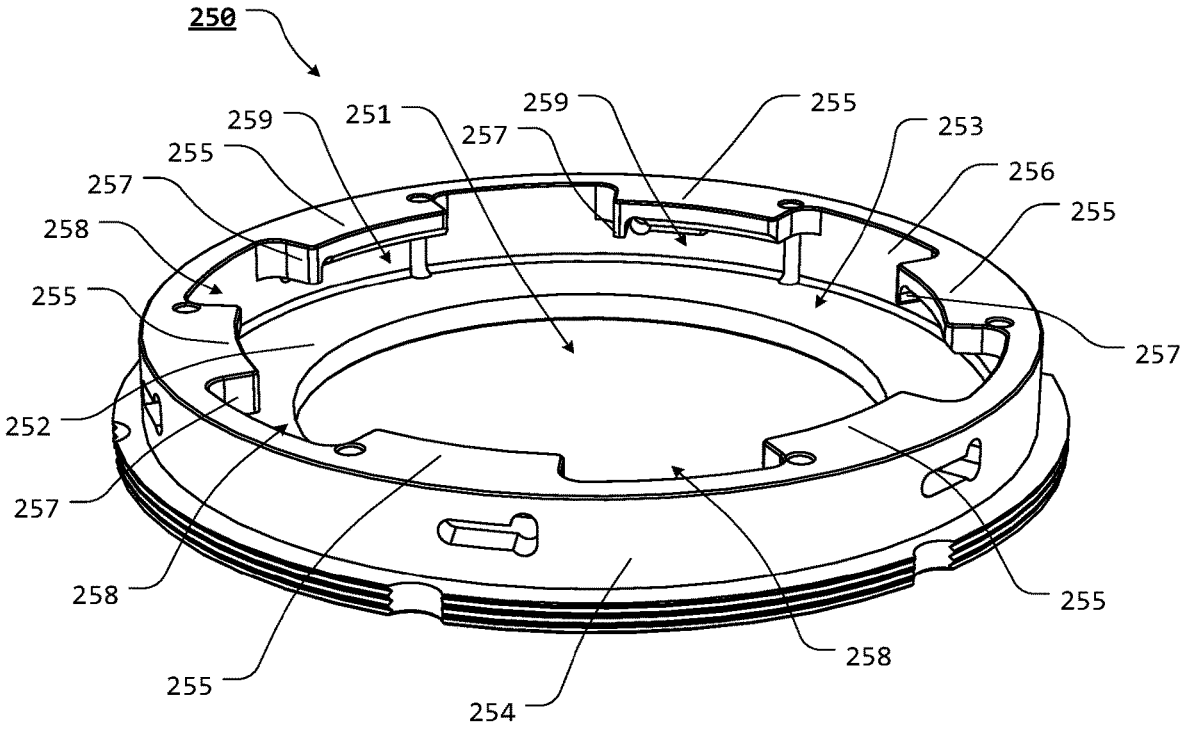
FIG. 19 illustrates an upper, front perspective view of an exemplary embodiment of a frame link portion, according to the present disclosure.
Figure 20:
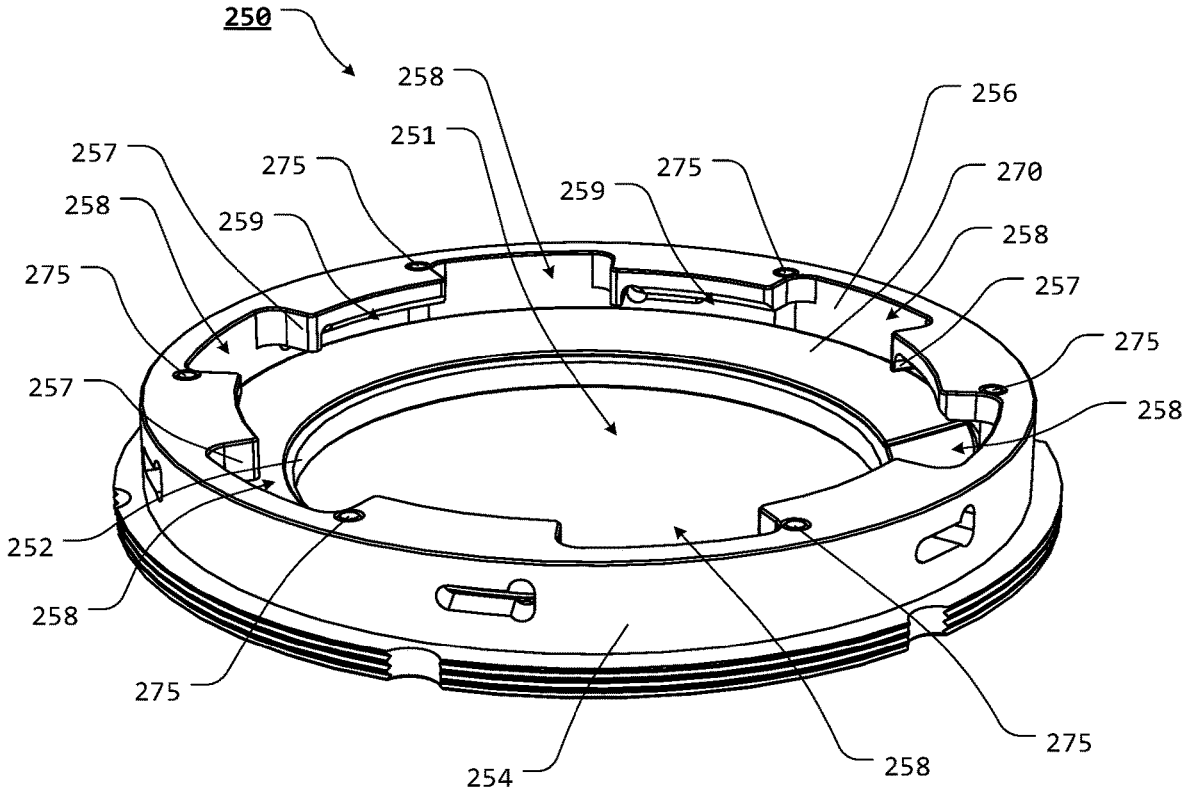
FIG. 20 illustrates an upper, front perspective view of an exemplary embodiment of a frame link portion, according to the present disclosure.
Figure 21:
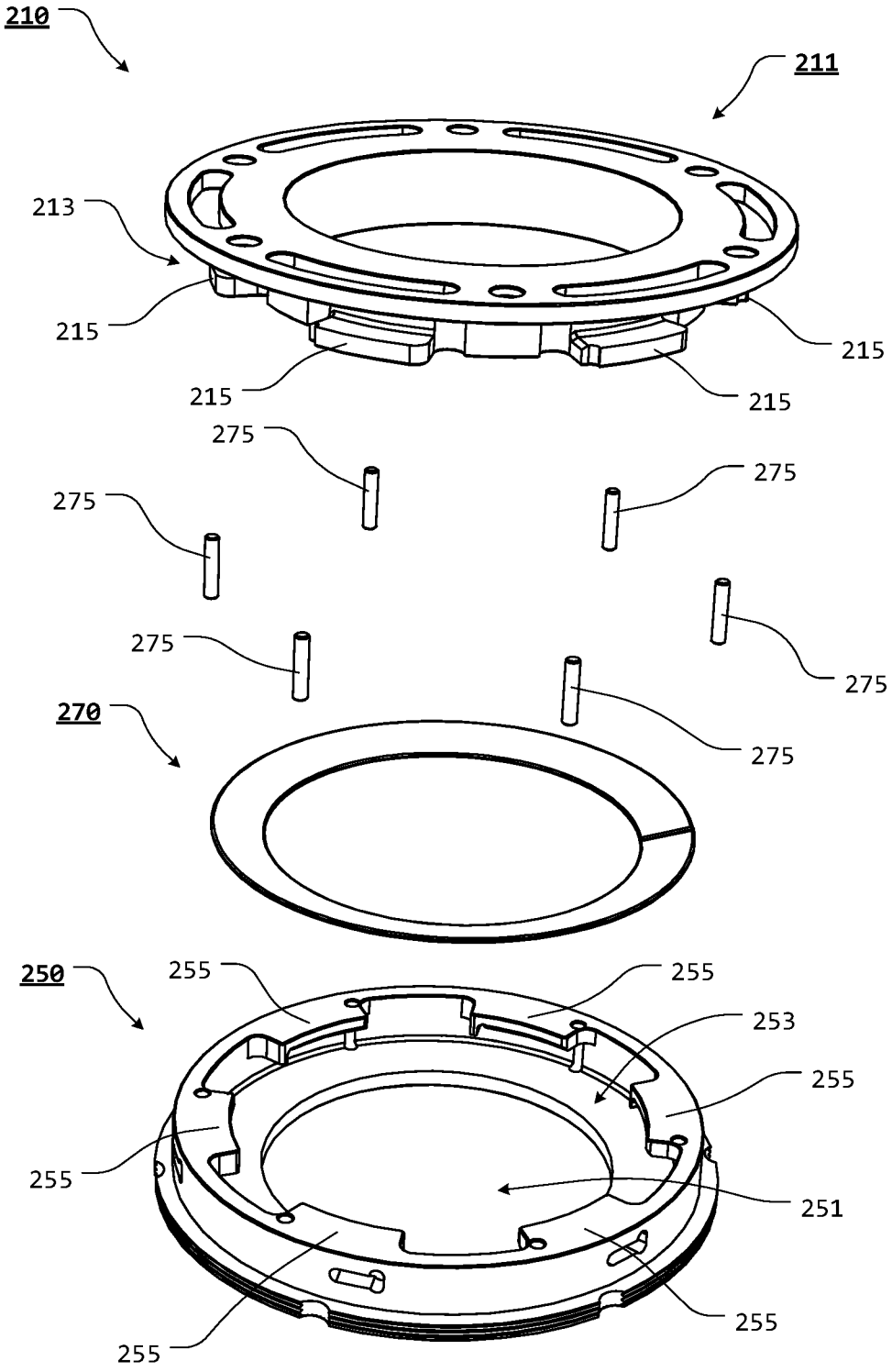
FIG. 21 illustrates an exploded upper, front perspective view of an exemplary embodiment of a coupling link, according to the present disclosure.

As most clearly illustrated in FIG. 8, a rear surface 102 of the frame element 104 may include a plurality of magnets 150 coupled within or on the rear surface 102 of the frame element 104. In particular implementations, the pad may include a plurality of magnets corresponding to the magnets 150 of the frame element 104 such that the pad may be repeatably removably attached or coupled to the frame element 104 through interaction of the magnets of the pad and the magnets 150. In particular implementations, the magnets 150 may be neodymium magnets 150. In various exemplary, nonlimiting embodiments, the magnets 150 may include other types of magnets 150. In implementations having magnets 150, the various types of padding may be quickly swapped out and securely fixed to the frame element 104 through the interaction of the magnets of the pad and the magnets 150. In various exemplary, nonlimiting embodiments, only the pad will include a plurality of magnets 150 or only the frame element 104 will include the plurality magnets 150. While FIG. 8 illustrates a particular number and configuration of magnets 150 relative to the frame element 104, it should be appreciated that the number and placement of magnets 150 is a design choice and that the number and placement of magnets 150 generally corresponds to the number and placement of magnets on or within a corresponding pad.

In various exemplary, nonlimiting embodiments, other types of attachment or coupling elements or devices, aside from magnets 150, may be used to secure a pad to the frame element 104. Such coupling elements or devices may include, by non-limiting example, hook and loop fasteners, adhesives, snaps, zippers, or any other type of coupling mechanism.

As illustrated, the backpack frame system 100 includes a coupling link 210. The coupling link 210 is configured to attach a load or other device to the frame element 104. Further, the implementations of backpack frame systems 100 including the coupling link 210 disclosed herein may enable a load to be securely and quickly attached or unattached from the frame element 104. In such implementations, a user may be able to use the same frame element 104 and quickly swap out loads depending on the intended use of the frame element 104. As used herein, "load" refers to any item or device coupled to the front surface 101 of the frame element 104. By non-limiting example, the load may include a bag, a cylinder for scuba divers, a jet pack unit, a rebreather apparatus, a skydiving container, an oxygen bottle for fire fighters, a climbing pack, a parachute, a tire, a fuel tank, a kayak, or any other device capable of being carried.

The coupling link 210 includes a frame link portion 250 and an accessory link portion 211. In various implementations of the present disclosure, the frame link portion 250 may optionally be integrally formed within the frame element 104 and may be considered as an integral part or component of the frame element 104.

The frame link portion 250 may optionally be formed within and considered as part of the frame element 104. The frame link portion 250 of the coupling link 210 may optionally be directly attached or coupled to the frame element 104. In various implementations of the present disclosure, the frame element 104 may include a coupling link opening 160 configured to receive at least a portion of the coupling link 210 at least partially therein. In such implementations, the frame link portion 250 of the coupling link 210 may be configured to be attached or coupled within the coupling link opening 160. In various exemplary embodiments, the frame link portion 250 may be configured to screw into the coupling link opening 160 by interaction of external threads of the frame link portion 250 and internal threads of the coupling link opening 160, be bolted to the frame element 104, be fixed to the frame element 104 through an adhesive, or may be otherwise fixedly attached or coupled to the frame element 104.

In various implementations of the present disclosure, the accessory link portion 211 may be removably attached to a load. In such implementations, the accessory link portion 211 may be attach to the load through one or more bolts, one or more screws, or any other type of coupling mechanism. In various exemplary, nonlimiting embodiments, the accessory link portion 211 of the coupling link 210 may be non-removably attached to the load. In particular implementations, the accessory link portion 211 may be physically sewn into the load or integrally formed with the load.

In various exemplary embodiments, the accessory link portion 211 optionally includes at least one attachment portion 212, which provides one or more areas, portions, or devices for fastening the accessory link portion 211 to a load or other device. Alternatively, the attachment portion 212 may comprise a one or more quick-disconnect or other couplings, which may be permanently or removably coupled to corresponding and cooperating coupling(s) provided on a load or other carrier or platform.

The accessory link portion 211 includes a protrusion 213 configured to fit at least partially within a recess 253 of the frame link portion 250. In various implementations of the present disclosure, the recess 253 within the frame link portion 250 may be substantially circular. The frame link portion 250 may optionally include one or more frame link recess tabs 255.

In various exemplary, nonlimiting embodiments, the frame link recess tab 255 may optionally extend from the frame link sidewall 256 of a frame link outer ring 254 of the frame link portion 250 and towards a middle of the recess 253 of the frame link portion 250.

The frame link portion 250 includes a plurality of frame link recess tabs 225. It should be appreciated that while the frame link portion 250 is illustrated as having six frame link recess tabs 255, the present disclosure is not so limited. Thus, in various exemplary, nonlimiting embodiments of the present disclosure, the frame link portion 250 may include one frame link recess tab 255, two frame link recess tabs 255, three frame link recess tabs 255, four frame link recess tabs 255, five frame link recess tabs 255, or any other number of frame link recess tabs 255.

The frame link portion 250 of the coupling link 210 includes a frame link portion gap 259 formed between each of the frame link recess tabs 255 and the frame link base 252 of the frame link portion 250. The frame link portion gaps 259 may be configured to receive corresponding accessory link protrusion tabs 215 of the accessory link portion 211 of the coupling link 210.

Each frame link recess tab 255 may include a frame link block 257 proximate an end portion of the frame link recess tab 255 and extending from the frame link recess tab 255 and towards the frame link base 252 of the frame link portion 250. In such implementations, if the accessory link portion 211 is rotatably locked within the frame link portion 250, the frame link block 257 may prevent the accessory link portion 211 from twisting and becoming free from the frame link portion 250.

In various implementations of the present disclosure, the coupling link 210 may optionally include a plurality of rods 275 either inserted into or formed within the frame link portion 250 of the coupling link 210. In such implementations, the rods 275 may also prevent the accessory link portion 211 from twisting and becoming free from the frame link portion 250.

In various exemplary, nonlimiting embodiments, each of the frame link recess tabs 255 may be separated by a frame link space 258 allowing a corresponding accessory link protrusion tab 215 of the accessory link portion 211 to be inserted within a corresponding recess 253 of the frame link portion 250.

In various implementations of the present disclosure, the accessory link portion 211 optionally includes a plurality of accessory link protrusion tabs 215, each defining an accessory link gap 219. The number of accessory link protrusion tabs 215 of the accessory link portion 211 may correspond to the number of frame link recess tabs 255 of the frame link portion 250 of the coupling link 210.

Further, in various implementations the size and perimeter of the accessory link protrusion tabs 215 of the accessory link portion 211 may be configured to fit within at least a portion of the frame link portion gap 259 between the frame link recess tab 255 of the frame link portion 250 and the frame link base 252 of the frame link portion 250.

The accessory link protrusion tabs 215 of the accessory link portion 211 may include an accessory link notch 216 configured to receive a rod 275 of the coupling link 210. An accessory link space 218 may be formed between each of the accessory link protrusion tabs 215 of the accessory link portion 211. The accessory link space 218 allows for the frame link recess tabs 255 of the frame link portion 250 to pass through the accessory link space 218 and allows the accessory link portion 211 to be inserted within the frame link portion 250 of the coupling link 210.

The coupling link 210 may include one or more disc springs 270. While the spring 270 is illustrated, for example, in FIGS. 13 and 21 one or more springs 270 are positioned relative to the accessory link portion 211 when the accessory link portion 211 is inserted within the frame link portion 250. In various exemplary embodiments, the disc spring 270 may be coupled to a frame link base 252 of the recess 253 of the frame link portion 250. In such implementations, the spring 270 may be configured to compress downwards when the accessory link protrusion tabs 215 of the accessory link portion 211 are inserted within the recess 253 of the frame link portion 250 and urge the spring 270 downwards. When the urging force is no longer applied, the spring bias of the spring 270 may urge the accessory link protrusion tabs 215 of the accessory link portion 211 upwards and either urge the accessory link portion 211 out of the frame link portion 250 or further secure the accessory link portion 211 within the frame link portion 250.

In various implementations of the present disclosure, the accessory link portion 211 may be configured to lock to the frame link portion 250 by inserting the accessory link portion 211 within the frame link portion 250, compressing the spring 270, twisting the accessory link portion 211 within the frame link portion 250 while the spring 270 is compressed such that the accessory link protrusion tabs 215 of the accessory link portion 211 are under the frame link recess tabs 255 of the frame link portion 250, and allowing the spring 270 to at least partially decompress in order to urge the accessory link protrusion tabs 215 of the accessory link portion 211 under the frame link recess tabs 255 of the frame link portion 250 and prevent twisting of the accessory link portion 211 in relation to the frame link portion 250 due to the frame link block 257 at the end of each of the frame link recess tabs 255 of the frame link portion 250.

It should be appreciated that in order for the accessory link portion 211 be locked within the frame link portion 250, the external accessory link protrusion tabs 215 of the accessory link portion 211 must pass through the frame link spaces 258 between the frame link recess tabs 255 of the frame link portion 250 and the accessory link portion 211 must be rotated such that the accessory link protrusion tabs 215 of the accessory link portion 211 are under the frame link recess tabs 255 of the frame link portion 250.

In various exemplary embodiments, the frame link portion 250 of the coupling link 210 may be considered the female portion and the accessory link portion 211 of the coupling link 210 may be considered the male portion inasmuch as it is received by the female portion. In various exemplary, nonlimiting embodiments the frame link portion 250 may be the male portion and the accessory link portion 211 may be the female portion.

In various exemplary, nonlimiting embodiments, the coupling link 210 may include other locking mechanisms configured to attach the accessory link portion 211 to the frame link portion 250.

In various exemplary embodiments, the frame link base 252 of the frame link portion 250 of the coupling link 210 may be solid. Alternatively, the frame link base 252 of the frame link portion 250 may include a frame link portion opening 251 formed therethrough.

It should be appreciated that any implementations or elements of the backpack frame system 100 and/or the coupling link 210 disclosed herein may be used with any other implementation of any other backpack frame system 100 or element thereof disclosed herein.

In the implementations disclosed herein, the backpack frame system 100 may be used for or in, by non-limiting example, military applications, police and fire departments, Maritime operations, air operations, commercial, technical, or civilian diving, search and rescue, space exploration, fishing, parachuting, paragliding, rock climbing, backpacking, recreational or sporting activities, emergency medical services, construction, disaster relief, the film and movie industry, air travel, hospitality, and or fitness. In such implementations, a user could attach a first load to the frame element 104, conduct a particular activity (such as scuba diving), remove the first load, and attach a second load, such as a particular pack gear for a particular military operation.

The implementations of the backpack frame system 100 disclosed herein may all meet military specifications and standards.

While the coupling link 210 disclosed herein is primarily discussed as attaching a load to a frame element 104 for a backpack, it is understood that the coupling link 210 may be used in various exemplary, nonlimiting embodiments not associated with a frame element 104 of a backpack. In such implementations, the coupling link 210 may be used to attach loads to, by non-limiting example, vehicles, walls, ceilings, or any other object. More specifically, the coupling link 210 may optionally be used to couple a spare tire or fuel tank to a vehicle, a weapon to a vehicle or drone, cameras to an object, computers to an object, a phone to a belt or clothing, a rack system for organization to a wall, or any other device to any other object. The coupling link 210 may be scaled up or scaled down in order to accommodate different loads attach to different objects.

The backpack frame systems 100 disclosed herein may be made of conventional materials used to make goods similar to these in the art, such as, by non-limiting example, polymers or metals. Those of ordinary skill in the art will readily be able to select appropriate materials and manufacture these products from the disclosures provided herein.

The implementations listed here, and many others, will become readily apparent from this disclosure. From this, those of ordinary skill in the art will readily understand the versatility with which this disclosure may be applied.

It should be appreciated that a more detailed explanation of the instructions regarding how to utilize the backpack frame system 100 and/or the coupling link 210 is not provided herein because it is believed that the level of description provided herein is sufficient to enable one of ordinary skill in the art to understand and practice the systems, methods, devices, and/or apparatuses of the present disclosure, as described.

While the presently disclosed systems, methods, and/or apparatuses has been described in conjunction with the exemplary embodiments outlined above, the foregoing description of exemplary embodiments of the presently disclosed systems, methods, and/or apparatuses, as set forth above, are intended to be illustrative, not limiting and the fundamental disclosed systems, methods, and/or apparatuses should not be considered to be necessarily so constrained. It is evident that the presently disclosed systems, methods, and/or apparatuses is not limited to the particular variation set forth and many alternatives, adaptations modifications, and/or variations will be apparent to those skilled in the art.

Furthermore, where a range of values is provided, it is understood that every intervening value, between the upper and lower limit of that range and any other stated or intervening value in that stated range is encompassed within the presently disclosed systems, methods, and/or apparatuses. The upper and lower limits of these smaller ranges may independently be included in the smaller ranges and is also encompassed within the presently disclosed systems, methods, and/or apparatuses, subject to any specifically excluded limit in the stated range. Where the stated range includes one or both of the limits, ranges excluding either or both of those included limits are also included in the presently disclosed systems, methods, and/or apparatuses.

It is to be understood that the phraseology of terminology employed herein is for the purpose of description and not of limitation. Unless defined otherwise, all technical and scientific terms used herein have the same meaning as commonly understood by one of ordinary skill in the art to which the presently disclosed systems, methods, and/or apparatuses belongs.

In addition, it is contemplated that any optional feature of the inventive variations described herein may be set forth and claimed independently, or in combination with any one or more of the features described herein. Accordingly, the foregoing description of exemplary embodiments will reveal the general nature of the presently disclosed systems, methods, and/or apparatuses, such that others may, by applying current knowledge, change, vary, modify, and/or adapt these exemplary, non-limiting embodiments for various applications without departing from the spirit and scope of the presently disclosed systems, methods, and/or apparatuses and elements or methods similar or equivalent to those described herein can be used in practicing the presently disclosed systems, methods, and/or apparatuses. Any and all such changes, variations, modifications, and/or adaptations should and are intended to be comprehended within the meaning and range of equivalents of the disclosed exemplary embodiments and may be substituted without departing from the true spirit and scope of the presently disclosed systems, methods, and/or apparatuses.

Also, it is noted that as used herein and in the appended claims, the singular forms "a", "and", "said", and "the" include plural referents unless the context clearly dictates otherwise. Conversely, it is contemplated that the claims may be so-drafted to require singular elements or exclude any optional element indicated to be so here in the text or drawings. This statement is intended to serve as antecedent basis for use of such exclusive terminology as "solely", "only", and the like in connection with the recitation of claim elements or the use of a "negative" claim limitation(s).

What is claimed is:

1. A backpack frame system, comprising:

a frame element having a front surface and a rear surface, wherein said frame element extends from a top to an upper portion, from said upper portion to a central portion, from said central portion to a lower portion, and from said lower portion to a bottom, wherein said frame element extends to one or more sides, and wherein a coupling link opening is formed within a portion of said central portion; and a coupling link, wherein said coupling link includes a frame link portion and an accessory link portion, wherein said accessory link portion includes at least one attachment portion, which provides one or more areas, portions, or devices for attaching or coupling a load or other device said accessory link portion, wherein said accessory link portion includes a protrusion configured to fit at least partially within a recess of said frame link portion, wherein said frame link portion is attached or coupled to said frame element, within at least a portion of said coupling link opening, wherein said frame link portion includes a plurality of spaced apart frame link recess tabs, wherein each of said frame link recess tabs is separated by a frame link space, wherein said accessory link portion includes a plurality of spaced apart accessory link protrusion tabs, wherein each of said accessory link protrusion tabs is separated by an accessory link space, wherein corresponding accessory link protrusion tabs of said accessory link portion may be inserted within a corresponding recess of said frame link portion, wherein said accessory link portion may be at least partially rotated relative to said frame link portion to engage corresponding accessory link protrusion tabs of said accessory link portion and frame link recess tabs of said frame link portion, and wherein one or more disc springs are positioned between portions of said accessory link portion and said frame link portion.

2. The backpack frame system of claim 1, wherein said frame element includes a first leg and a second leg extending as an integral component of said central portion to said bottom of said frame element.

3. The backpack frame system of claim 2, wherein said first leg and said second leg each extend away from one another.

4. The backpack frame system of claim 1, wherein said frame element includes a first arm and a second arm extending as an integral component of said central portion to said top of said frame element.

5. The backpack frame system of claim 4, wherein said first arm and said second arm each extend away from one another.

6. The backpack frame system of claim 1, wherein a thickness of said central portion is greater than a thickness of said first leg, said second leg, said first arm, and/or said second arm.

7. The backpack frame system of claim 1, wherein one or more portions of said backpack frame are formed of a substantially rigid material.

8. The backpack frame system of claim 1, wherein a handle is attached or coupled to said frame element.

9. The backpack frame system of claim 1, wherein a plurality of strap openings extend through said frame element proximate said one or more sides.

10. The backpack frame system of claim 1, wherein a plurality of magnets is attached or coupled to said frame element proximate said rear surface of said frame element.

11. The backpack frame system of claim 1, wherein each of said frame link recess tabs extends from a frame link sidewall of a frame link outer ring of said frame link portion and towards a proximate middle of said recess of said frame link portion.

12. The backpack frame system of claim 1, wherein a number of said spaced apart frame link recess tabs corresponds to a number of said spaced apart accessory link protrusion tabs.

13. The backpack frame system of claim 1, wherein said coupling link includes a plurality of rods inserted into a portion of said frame link portion of said coupling link.

14. The backpack frame system of claim 1, wherein said frame link portion of said coupling link includes a frame link portion gap formed between each of said frame link recess tabs and said frame link base of said frame link portion, wherein each frame link portion gap is configured to receive a portion of a corresponding accessory link protrusion tab of said accessory link portion of said coupling link.

15. The backpack frame system of claim 1, wherein said accessory link portion of said coupling link includes an accessory link gap formed between each of said accessory link protrusion tabs and a portion of said accessory link portion, wherein each accessory link gap is configured to receive a portion of a corresponding frame link recess tab of said frame link portion of said coupling link.

16. The backpack frame system of claim 1, wherein said accessory link protrusion tabs of said accessory link portion include an accessory link notch configured to receive a rod of said coupling link.

17. A backpack frame system, comprising:

a frame element having a front surface and a rear surface, wherein said frame element extends from an upper portion, from said upper portion to a central portion, and from said central portion to a lower portion, and wherein said frame element extends to one or more sides; and a coupling link, wherein said coupling link includes a frame link portion and an accessory link portion, wherein said accessory link portion includes at least one attachment portion, which provides one or more areas, portions, or devices for attaching or coupling a load or other device said accessory link portion, wherein said accessory link portion includes a protrusion configured to fit at least partially within a recess of said frame link portion, wherein said frame link portion is integrally formed within a portion of said frame element as an integral part or component of said frame element, wherein said frame link portion includes a plurality of spaced apart frame link recess tabs, wherein each of said frame link recess tabs is separated by a frame link space, wherein said accessory link portion includes a plurality of spaced apart accessory link protrusion tabs, wherein each of said accessory link protrusion tabs is separated by an accessory link space, wherein corresponding accessory link protrusion tabs of said accessory link portion may be inserted within a corresponding recess of said frame link portion, wherein said accessory link portion may be at least partially rotated relative to said frame link portion to engage corresponding accessory link protrusion tabs of said accessory link portion and frame link recess tabs of said frame link portion, and wherein one or more disc springs are positioned between portions of said accessory link portion and said frame link portion.

18. The backpack frame system of claim 17, wherein said frame element includes a first leg and a second leg extending as an integral component of said central portion to said lower portion of said frame element, wherein said first leg and said second leg each extend away from one another, wherein said frame element includes a first arm and a second arm extending as an integral component of said central portion to said upper portion of said frame element, and wherein said first arm and said second arm each extend away from one another.

19. A backpack frame system, comprising:

a frame element, wherein said frame element includes a central portion, wherein said frame element extends to one or more sides, and wherein a coupling link opening is formed within a portion of said central portion; and a coupling link, wherein said coupling link includes a frame link portion and an accessory link portion, wherein said accessory link portion includes at least one attachment portion, which provides one or more areas, portions, or devices for attaching or coupling a load or other device said accessory link portion, wherein said frame link portion is attached or coupled to said frame element, within at least a portion of said coupling link opening, wherein said frame link portion includes a plurality of spaced apart frame link recess tabs, wherein each of said frame link recess tabs is separated by a frame link space, wherein said accessory link portion includes a plurality of spaced apart accessory link protrusion tabs, wherein each of said accessory link protrusion tabs is separated by an accessory link space, wherein corresponding accessory link protrusion tabs of said accessory link portion may be inserted within a corresponding recess of said frame link portion, wherein said accessory link portion may be at least partially rotated relative to said frame link portion to engage corresponding accessory link protrusion tabs of said accessory link portion and frame link recess tabs of said frame link portion, and wherein one or more disc springs are positioned between portions of said accessory link portion and said frame link portion.

20. The backpack frame system of claim 19, wherein said frame element includes a first leg and a second leg extending as an integral component of said central portion, wherein said first leg and said second leg each extend away from one another, wherein said frame element includes a first arm and a second arm extending as an integral component of said central portion, and wherein said first arm and said second arm each extend away from one another.

* * * * *